US011768018B2

(12) United States Patent
Desmarais

(10) Patent No.: US 11,768,018 B2
(45) Date of Patent: Sep. 26, 2023

(54) DOUBLE HYBRID HEAT PUMPS AND SYSTEMS AND METHODS OF USE AND OPERATIONS

(71) Applicant: Matthew Desmarais, Albany, NY (US)

(72) Inventor: Matthew Desmarais, Albany, NY (US)

( * ) Notice: Subject to any disclaimer, the term of this patent is extended or adjusted under 35 U.S.C. 154(b) by 0 days.

(21) Appl. No.: 17/661,818

(22) Filed: May 3, 2022

(65) Prior Publication Data

US 2022/0349631 A1 Nov. 3, 2022

Related U.S. Application Data

(60) Provisional application No. 63/183,615, filed on May 3, 2021.

(51) Int. Cl.

| | |
|---|---|
| ***F25B 30/02*** | (2006.01) |
| ***F24H 4/04*** | (2006.01) |
| ***F25B 13/00*** | (2006.01) |

(52) U.S. Cl.

CPC ..... *F25B 30/02* (2013.01); *F24H 4/04* (2013.01); *F25B 13/00* (2013.01); *F25B 2339/047* (2013.01)

(58) Field of Classification Search

CPC .. F24H 4/04; F25B 30/02; F25B 13/00; F25B 2339/047

See application file for complete search history.

(56) References Cited

U.S. PATENT DOCUMENTS

| | | | |
|---|---|---|---|
| 4,249,390 | A | 2/1981 | Jones |
| 4,528,822 | A | 7/1985 | Glamm |
| 4,598,557 | A | 7/1986 | Robinson |
| 4,645,908 | A | 2/1987 | Jones |
| 4,653,287 | A | 3/1987 | Martin |
| 4,688,396 | A | 8/1987 | Takahashi |
| 4,924,681 | A | 5/1990 | Devit |
| 5,806,331 | A | 9/1998 | Brown |

(Continued)

OTHER PUBLICATIONS

GeoSmart Energy, Systems Operation Technical Manual, Oct. 2016, Cambridge, Ontario, Canada.

(Continued)

*Primary Examiner* — Henry T Crenshaw
(74) *Attorney, Agent, or Firm* — Nemphos Braue LLC; Michael Antone

(57) ABSTRACT

Double hybrid heat pumps, systems, and methods of operation that provide increased efficiency in both heating and cooling modes, heated water, and other advantages. The system includes a compressor for compressing low-pressure vapor phase refrigerant to high-pressure vapor phase refrigerant, a refrigerant condensing heat exchanger to heat water and cool the refrigerant to a high-pressure liquid refrigerant, which is provided to a refrigerant cooling heat exchanger in which any remaining high-pressure vapor phase refrigerant is condensed and the high-pressure liquid refrigerant is further cooled. The high-pressure cooled liquid refrigerant is passed through an expansion valve to drop the pressure of the cooled liquid to yield a low-pressure cooled liquid refrigerant or low-pressure cooled two-phase refrigerant. The low-pressure cooled liquid or two-phase refrigerant is then evaporated in a refrigerant evaporating heat exchanger to produce the low-pressure vapor refrigerant that is returned to the compressor.

18 Claims, 18 Drawing Sheets

(56) References Cited

U.S. PATENT DOCUMENTS

| | | | | |
|---|---|---|---|---|
| 6,212,894 | B1 | 4/2001 | Brown | |
| 6,434,972 | B1 | 8/2002 | Geiger | |
| 8,056,348 | B2 | 11/2011 | Murakami | |
| 8,074,459 | B2 | 12/2011 | Murakami | |
| 8,079,229 | B2 | 12/2011 | Lifson | |
| 8,220,531 | B2 | 7/2012 | Murakami | |
| D700,689 | S | 3/2014 | Obosu | |
| 8,756,943 | B2 | 6/2014 | Chen | |
| 8,789,382 | B2 | 7/2014 | Ko | |
| 9,383,126 | B2 | 7/2016 | Chen | |
| 9,562,708 | B2 | 2/2017 | Medlock | |
| 9,739,492 | B2 | 8/2017 | Medlock | |
| 10,107,508 | B2 | 10/2018 | Medlock | |
| 10,119,738 | B2 | 11/2018 | Hammond | |
| 10,753,661 | B2 | 8/2020 | Hammond | |
| 10,788,227 | B2 | 9/2020 | Brown | |
| 10,866,002 | B2 | 12/2020 | Taras | |
| 10,900,675 | B2 | 1/2021 | Medlock | |
| 10,907,848 | B2 | 2/2021 | Wallace | |
| 2015/0285539 | A1* | 10/2015 | Kopko | F25B 41/39<br>62/324.1 |
| 2021/0018234 | A1* | 1/2021 | Lingrey | F25B 13/00 |

OTHER PUBLICATIONS

ClimateMaster Geothermal Heating & Cooling, Trilogy Q-Mode (QE) Series IOM, Residential Horizontal, Vertical & Downflow Packaged Geothermal Heat Pumps Installation, Operation & Maintenance Instructions, 97B0112N01, Jul. 25, 2017, Oklahoma City, Oklahoma, USA.

* cited by examiner

Cooling Mode

Cooling Mode

Double Hybrid refrigeration cycle

Typical refrigeration cycle

Double Hybrid refrigeration cycle

Typical refrigeration cycle

High Temperature, High pressure, vapor
Partially or fully condensed, high pressure, gas/liquid
Low Temperature, High pressure, liquid
Low Temperature, Low pressure, gas/liquid
Low Temperature, Low pressure, gas
Water or other heat transfer fluid

DOUBLE HYBRID HEAT PUMPS AND SYSTEMS AND METHODS OF USE AND OPERATIONS

CROSS-REFERENCE TO RELATED APPLICATIONS

This application claims priority to and the benefit of U.S. Provisional Patent Application No. 63/183,615 filed on May 3, 2021, which is incorporated by reference in its entireties.

STATEMENT REGARDING FEDERALLY SPONSORED RESEARCH OR DEVELOPMENT

Not Applicable

BACKGROUND OF THE INVENTION

Field of the Invention

The present invention generally relates to heat pumps. More specifically, the invention relates to hybrid heat pumps that may be used in combination with hot water and forced air systems for heating and domestic water supply and cooling systems.

Background Art

Residential, commercial and industrial heat pump systems are a growing market worldwide because they can be high efficiency and may be used to replace less efficient heating and cooling systems. The growth in heat pumps has been primarily in new homes or existing residences that have forced hot air heating systems. Presently, converting homes that are heated by hot water is prohibitively expensive for the average homeowner. Retrofitting these homes are limited to several expensive options, which include for example:

1. Replacing every radiator or baseboard with larger radiators or panel radiators or baseboards that can operate at low heating supply temperatures (between 110-120 degrees)
2. Replacing the hot water system with a forced hot air system,
3. Using two heat pumps to provide hot air and water at the same time, or
4. Adding several hydronic air handlers and ductwork to supplement the heat output from the existing heating system.

The cost of these options can range from $70,000-$100,000, which is far too expensive for a typical homeowner. Additionally, the level of complexity in these retrofits can make these jobs undesirable to installers as well. The uptake of heat pump systems in the commercial and industrial markets has been slower than residential due, at least in part, to the additional complexity and requirements of these systems, such as the need for chilled water, etc.

As such, there is a continuing need for heat pumps, systems, and methods that may be used in new installations and retrofit applications for both existed forced air and water heating systems with lower cost and higher performance for residential, commercial and industrial buildings.

BRIEF SUMMARY OF THE INVENTION

The present invention addresses the above noted needs by providing a double hybrid heat pump that may be used in new installations as well as retrofit applications for building with forced air or hot water heating systems.

The double hybrid heat pump includes a compressor for compressing low-pressure vapor phase refrigerant to high-pressure vapor phase refrigerant, a refrigerant to water condensing heat exchanger to produce and store heated water using heat from the high-pressure refrigerant. The condensed refrigerant then proceeds to a refrigerant cooling heat exchanger which exchanges heat with a lower temperature fluid than was used to exchange heat in the condensing heat exchanger, in which the high-pressure liquid refrigerant is further cooled. The high-pressure cooled liquid refrigerant is passed through an expansion valve to drop the pressure of the cooled liquid. The low-pressure cooled liquid or liquid/gas two phase mixture refrigerant is then provided to a refrigerant evaporating heat exchanger to vaporize the low-pressure refrigerant before it is returned to the compressor.

In various embodiments, the water heated by the condensing heat exchanger is provided to one or both of 1) a hot water tank for storage or for use as domestic hot water and 2) a hydronic heating loop that may serve a variety of uses. For example, in a hot water heating system including a boiler, in the heating mode, the double hybrid heat pump may make hot water for use as either domestic hot water or hydronic hot water to as a replacement for the boiler for heating, as well as providing hot air from the inside refrigerant to air heat exchanger for heating. Whereas, in the cooling mode, the double hybrid heat pump may provide hot water for domestic hot water and cool air for air conditioning. While in cooling mode, the first condenser shall first absorb the heat rejected by the compressor and any remaining heat will be rejected outside the system. In cooling mode, if the conditions permit, the system can prioritize condensing for producing useful hot water and then use a favorable temperature difference to further subcool the refrigerant before it reaches the thermal expansion valve, increasing the net efficiency of the system greatly.

The double hybrid heat pump may be used to eliminate many external components, complicated controls, and the huge amount of labor required to retrofit a home from an existing hot water heating system to a ground or water source heat pump. It can be installed with minimal training and has built-in features that limit the risk to the contractor. For example, in a hot water heating system, the present invention may be used to eliminate a domestic hot water pre-heat tank, 1 heat pump, 1 flow center, 1 HDPE manifold, 1 circulator, domestic hot water piping, hydronic fan coils and extra zone controls which result in substantial installation and operational savings.

Accordingly, the present disclosure addresses the continuing need for HVAC systems with improved cost and performance.

BRIEF DESCRIPTION OF THE DRAWINGS

The accompanying drawings are included for the purpose of exemplary illustration of various aspects of the present invention, and not for purposes of limiting the invention, wherein.

Figure 1A:
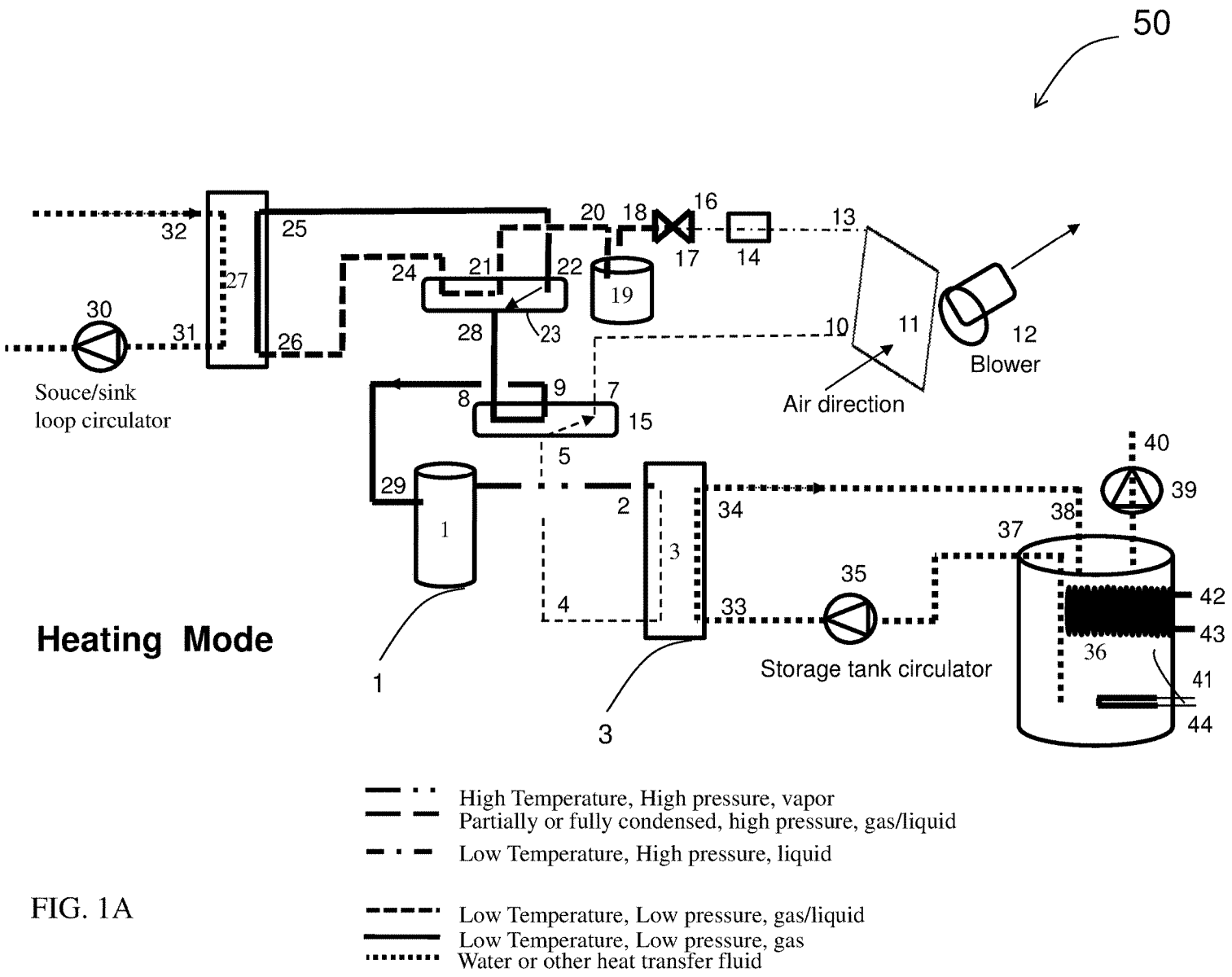
FIGS. 1A-2B depict exemplary schematic embodiments of the double hybrid heat pumps.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

DETAILED DESCRIPTION OF THE INVENTION

Systems 100, double hybrid heat pumps 50, and methods of use, operation, and control of the present invention may be employed in various heating and water supply solutions in a structure 200.

FIGS. 1A-2B depict exemplary schematic embodiments of double hybrid heat pumps 50. A compressor 1 receives at an inlet and then compresses a low-pressure vapor phase refrigerant to high-pressure vapor phase refrigerant, which passes through an outlet and is provided via connection 2 to an inlet to a refrigerant condensing heat exchanger 3. The refrigerant passes through the condensing heat exchanger 3 and is cooled by a first cooling fluid, which depending upon the application may be water or another fluid that may be used elsewhere. In various embodiments, the first cooling fluid may be circulated through the condensing heat exchanger 3 from a tank 36 using a storage tank circulator pump 35 via connections from 33, 34, 37 and 38 to remove heat from the high-pressure vapor phase refrigerant. It will be appreciated the high-pressure vapor phase refrigerant may be fully or partially condensed to a liquid at the outlet to the condensing heat exchanger 3. Where the refrigerant is partially condensed, a two phase refrigerant mixture will exit the refrigerant condensing heat exchanger 3 and be fully condensed and subcooled in a cooling heat exchanger as described herein.

The condensed refrigerant is provided from the outlet of the condensing heat exchanger 3 via connection 4 to a reversing element 15 via port 5 serving as an inlet. It will be appreciated by one skilled in the art that word "port" as used herein may describe access points to hardware and/or software. For example, a port may serve as an inlet or entry point to a device or an outlet or exit point from a device depending upon the direction of fluid flow, current flow, etc. Similarly, a connection may be a direct or indirect physical or logical connection between hardware and/or software.

Figure 2A:
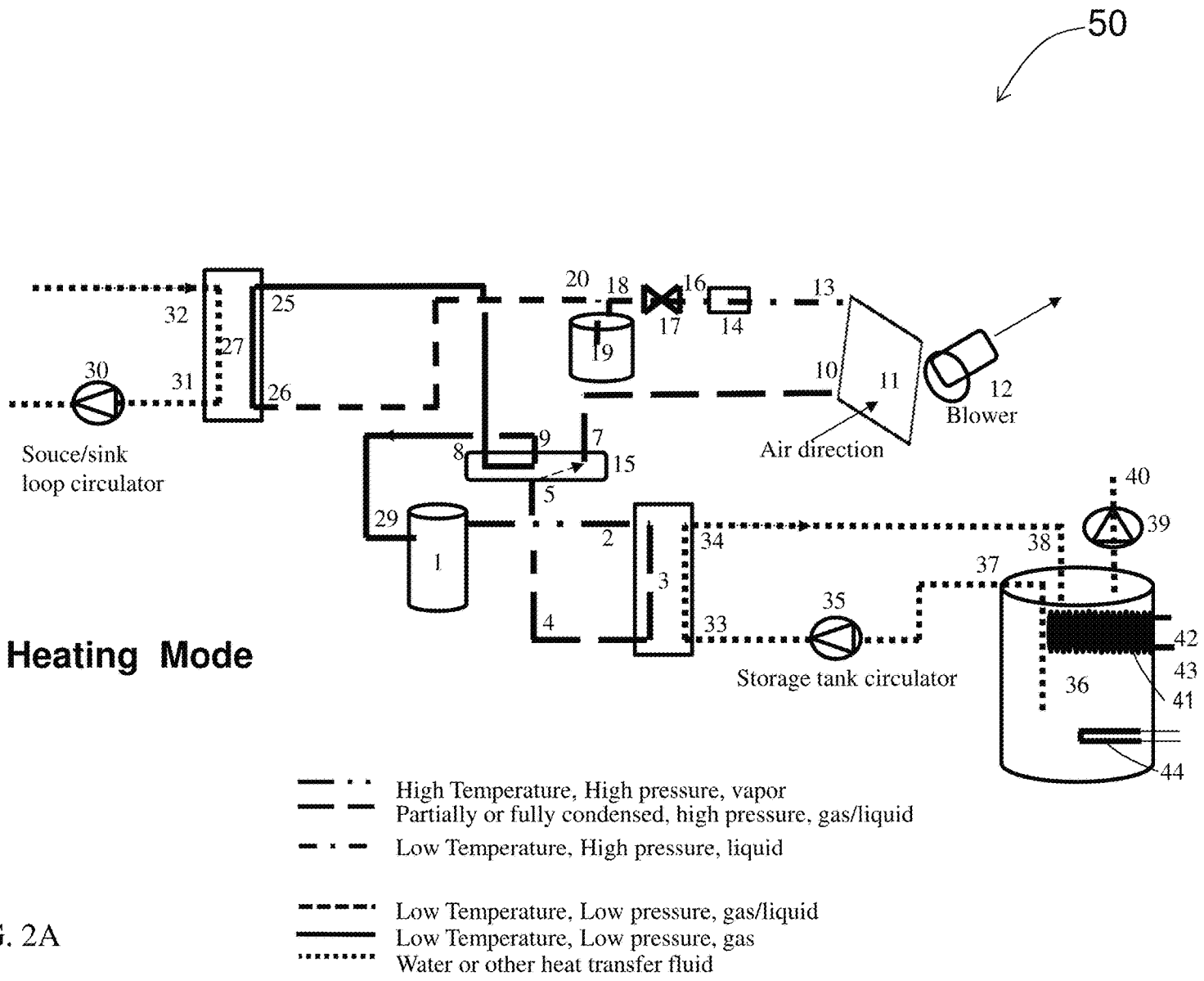

In heating modes, such as depicted in FIGS. 1A&2A, the reversing element 15 configured to pass the condensed refrigerant via connection 7 to a refrigerant-second fluid heat exchanger 11 via port 10 serving as an inlet, which serves as a refrigerant cooling heat exchanger further cooling the fully or partially condensed liquid using a second cooling fluid, e.g., air, to remove the heat from the refrigerant. The second cooling fluid may be used for other applications, such as providing heated air for heating the structure 200, or exhausted.

It will be appreciated by the skilled artisan that maintaining the temperature of the second cooling fluid, e.g., air, below the temperature of the first cooling fluid, e.g., water, the refrigerant can be subcooled more than achievable with only the first cooling fluid and greater efficiency can be derived from the system 50 relative to the prior art.

The heat exchanger 11 is usually deployed inside the structure 200. In various embodiments, the compressor 1, condensing heat exchanger-storage tank 36, and heat exchanger 11 may be housed in the same physical unit or multiple units that may be deployed in proximity for ease of installation and maintenance. It will be further appreciated that heat exchangers and other devices employed in the present invention may include one or more stages that may be operated as a single unit or separately by those skilled in the art.

In various embodiments using air as the second fluid, one or more blowers 12 may be provided proximate the heat exchanger 11 that may be controlled to control the amount of heat being transferred in the heat exchanger 11. The blowers 12 may be connected to ductwork inside the structure 200 to enable heated and cooled air to be distributed in the structure 200 in the heating and cooling modes, respectively. Various control algorithms may be used to control the amount of heat extracted by the blowers 12 to control for human comfort by balancing the flowrate of the air, refrigerant temperature and secondary effects caused by the further cooling of the refrigerant. By using the relatively cool temperature of the return air to subcool the condensed liquid entering the heat exchanger 11 via port 10, more heat can be extracted from the refrigerant and increase overall efficiency. The cooler refrigerant is then able to absorb more heat at heat exchanger 27 per pound of refrigerant that passes through the system.

In the heating mode, such as depicted in FIGS. 1A&2A, the high-pressure cooled refrigerant exits cooling heat exchanger 11 via port 13 serving as an outlet and is provided to an expansion valve 17. A reversable filter dryer 14 may be deployed between the refrigerant-air heat exchanger and expansion valve 17, or elsewhere is the system 50 to remove debris from the refrigerant. The expansion valve 17 imparts a pressure drop on the high-pressure cooled refrigerant and outputs the refrigerant in a low-pressure cooled liquid state or a two-phase mixture as may be desired. The expansion valve 17 may be connected to an accumulator tank to store refrigerant if the amount of refrigerant needed from the heating and cooling mode differs for an embodiment of the system 50. While the term expansion valve 17 is used herein, it will be appreciated that the term expansion valve may include other types of expansion designed to induce a pressure drop in the system 50.

In FIG. 1A embodiments, the refrigerant leaves the accumulator tank via port 20 and enters a reversing element 23 at port 21. In heating mode, the refrigerant is directed by the reversing element 23 to exit port 24 and travel to a refrigerant to source heat exchanger 27, which, in the heating mode serves as an evaporating heat exchanger for the refrigerant.

The heat exchanger 27 is sometimes deployed outside the structure 200. The heat exchanger 27 may be embodied in various heat exchanger designs employing various heat exchanger media including gas, solid, or liquid, as is known in the art. For example, the heat exchanger 27 may be a geo-thermal heat exchanger in which heat is exchanged with solid ground and/or water in a well, or a refrigerant-air heat exchanger.

The low-pressure vaporized refrigerant enters and exits the heat exchanger 27 via connections 26 and 25, respectively, and travels to reversing element 23. In heating mode, the low-pressure vaporized refrigerant enters and exits the reversing element 23 via ports 22 and 28, respectively. As is known in the art, some reversing element 23, e.g., valves, come with a smaller inlet than outlet and an appropriate reversing element must be selected to allow for a small pressure drop across port 28. For instance, a 3 ton compressor which uses a ⅞" suction inlet on the compressor may be best served by a reversing element with at least a ⅝" inlet on port 28, but for further pressure reduction and higher efficiency, one may employ a larger reversing element with a ⅞" inlet.

The low-pressure vaporized refrigerant leaves port 28 and travels to port 8 on reversing element 15. In heating mode, the low-pressure vapor refrigerant exits reversing element 15 via port 9 and is returned to the compressor 1 via connection 29 to complete and repeat the cycle.

Figure 1B:
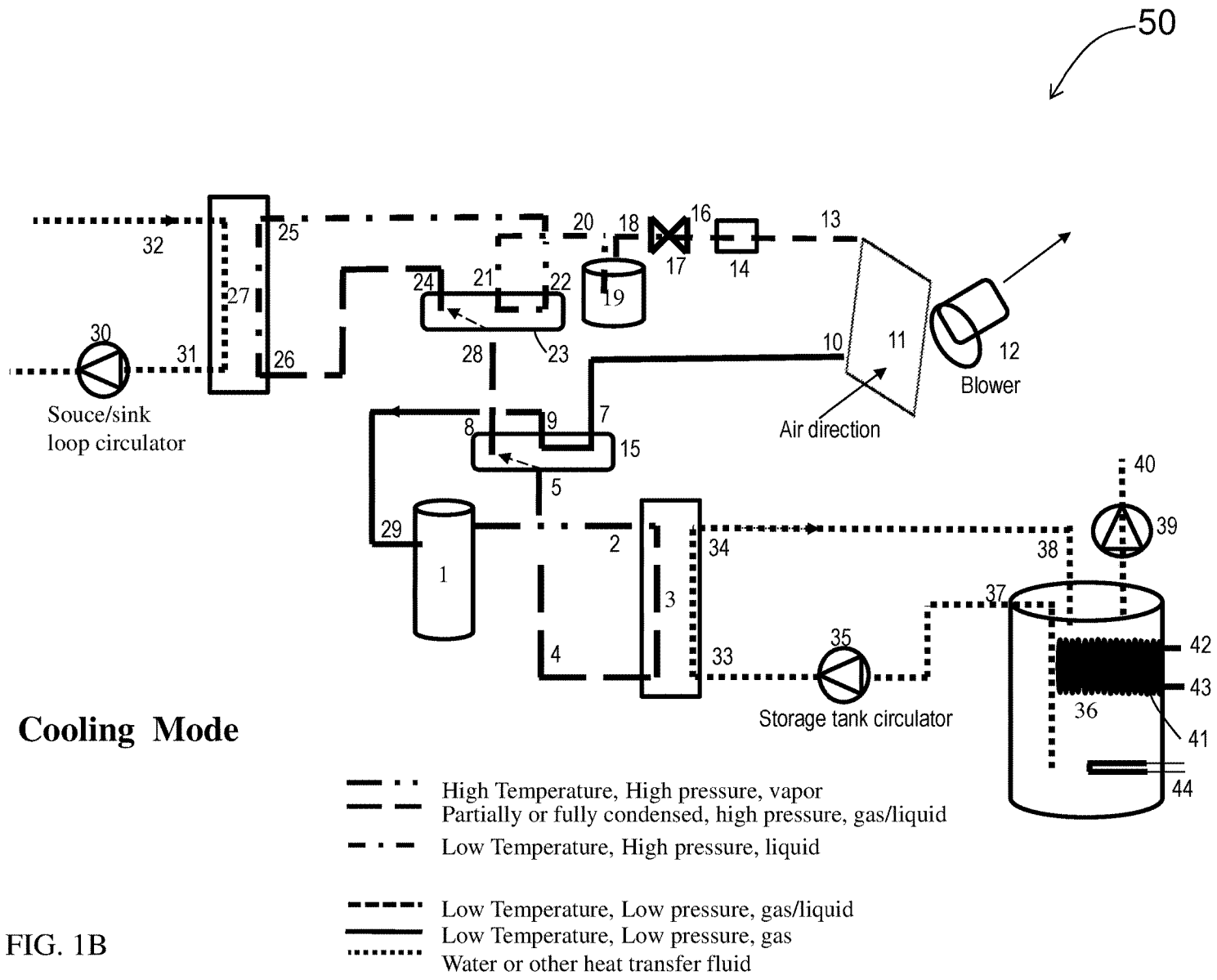

The reversing element 23 used in FIGS. 1A&1B embodiments, enables the heat exchanger 27 to be operated either in a counterflow or concurrent flow configuration for both heating and cooling. As is known to those skilled in the art, the flow configuration can significantly vary the performance of system 50, when the heat exchanger 27 is configured to employ a heating exchange fluid being pumped by a pump 30 through the heat exchanger 27 via ports 32 and 31. It will also be appreciated that if refrigerant heat exchanger 27 is a source/sink heat exchanger, i.e. the heat exchange media is a plenum (ground, large volume of air, water or other fluid) that can be treated as a constant temperature on the timescale of the heat exchanger, then the flow direction does not impact the efficiency of the heat exchanger 27.

Figure 2B:
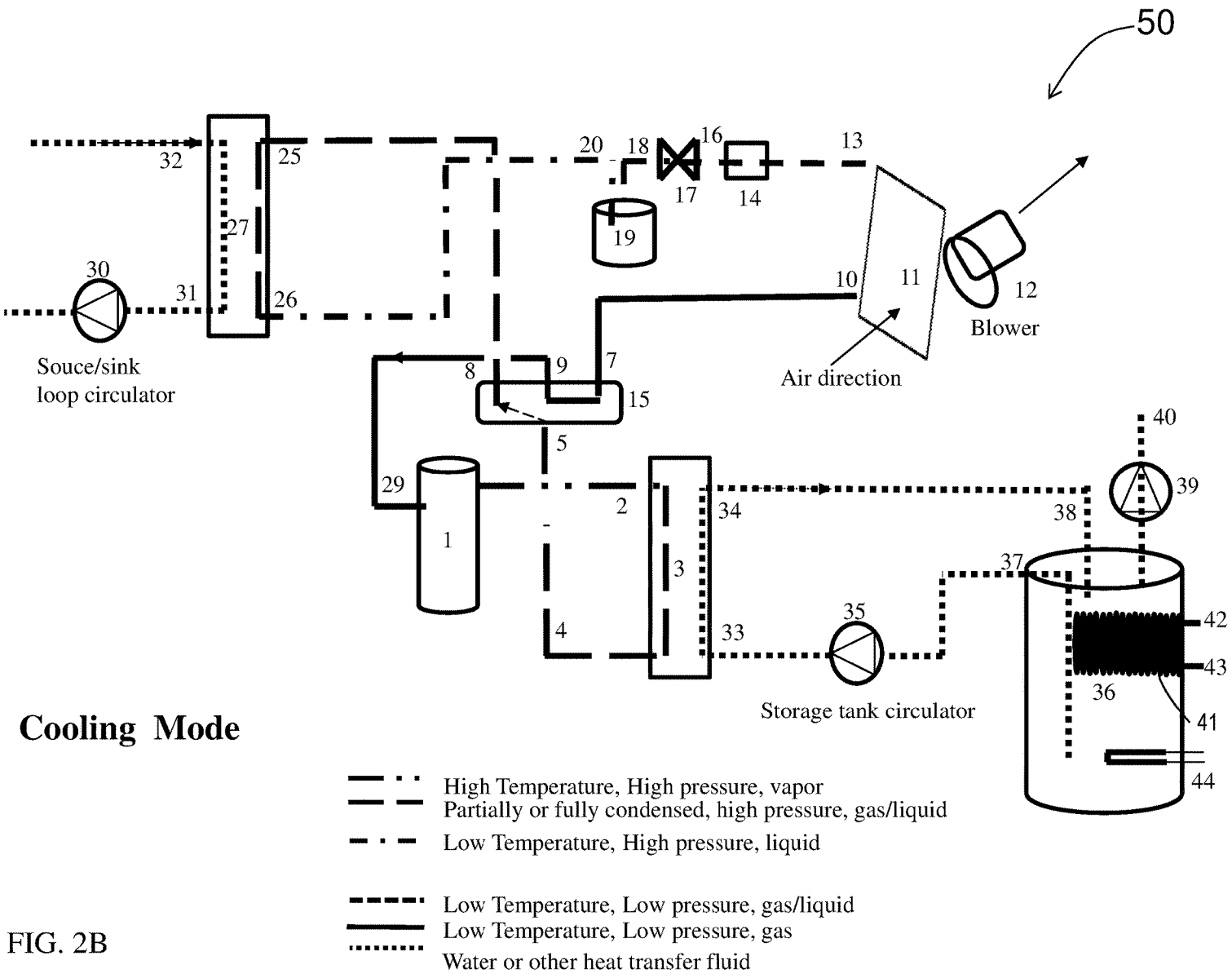

In cooling modes, as depicted in FIGS. 1B and 2B, reversing element 15 is set to pass the high-pressure liquid refrigerant from condensing heat exchanger 3 to refrigerant-source heat exchanger 27 via connection 5 to port 8 and in FIGS. 1A&1B embodiments, also via reversing element 23 via port 28. Reversing element 23 is also shifted to send high-pressure refrigerant through port 24 to heat exchanger 27. In the cooling mode, the refrigerant to source heat exchanger 27 serves as a refrigerant cooling heat exchanger further cooling the liquid refrigerant and outputting cooled liquid refrigerant via connection 25.

Similar to in heating mode, a control algorithm is typically employed to adjust the amount of heat extraction from heat exchanger 27. If heat exchanger 27 has a lower temperature than heat exchanger 3, it may be capable of subcooling the refrigerant entering the expansion valve 17 to a substantial degree, which will increase the cooling capacity of the evaporating heat exchanger 11 compared with using heat exchanger 3 alone. More generally speaking, when the refrigerant cooling heat exchanger is used to exchange heat with a heat exchange media that is at a lower temperature than the water exchanging heat with the refrigerant in the refrigerant condensing heat exchanger, the overall efficiency of the system 100 may be improved.

In cooling mode, with proper regulation of the speed of pump 30 to the source/sink heat exchanger, the system 50 will be able to condense high-pressure refrigerant in heat exchanger 3 and then further subcool this liquid with heat exchanger 27. The amount of subcooling will depend on the relative temperatures of the interacting fluids on heat exchanger 3 and 27, and the size and design of the heat exchangers. The refrigerant, being thoroughly condensed and subcooled, will be capable of extracting more heat from heat exchanger 11 and improving efficiency in cooling mode.

In FIG. 1B embodiments, the refrigerant passes back through reversing element 23 via port 22 and port 21. Excess refrigerant, if any, may be collected in the accumulation tank 19 at port 20 and re-enter the circulation loop via port 18. The circulating high-pressure subcooled liquid refrigerant pass through the expansion valve 17, which imparts a pressure drop to the refrigerant yielding low-pressure cooled liquid refrigerant.

The low-pressure cooled liquid refrigerant is provided via port 13 to the heat exchanger 11, which serves as the evaporating heat exchanger. The refrigerant is partially or fully evaporated in the heat exchanger 11 and exits via port 10. In various embodiments, the blowers 12 circulate the cooled air from the heat exchanger 11 throughout the structure 200 via the ductwork. However, other heat exchange media may be employed in heat exchanger 11 depending upon various factors, such as desired efficiency and/or uses of the energy being transferred from the refrigerant.

In the cooling mode, the low-pressure vaporized refrigerant exiting the heat exchanger 11 via port 9 and is returned to the compressor 1 via the reversing element 15 through ports 7 and 9 to complete and repeat the cycle.

FIGS. 1A-2B embodiments may be employed to provide simultaneously both hot water for heating and domestic hot water use and hot air for heating in heating modes and hot water for domestic hot water use and cool air in cooling modes. Where applications may require, such as in a building with dehumidification that calls for simultaneous heating and cooling, chilled air can be produced from cooled water from the source loop at the same time as hot water and domestic hot water. The hot water for use in both modes may be provided via the tank 36. Domestic hot water may be provided via a water to water heat exchanger 41, often called an indirect heat exchanger, in tank 36, via ports 42 and 43 and hot water for heating via circular pump 39 and connection 40.

It will be appreciated that hot water production may be effectively bypassed or reduced and the heat pump system 50 may be used solely for providing hot or cool air by reducing the flow from circulator 35 to heat exchanger 3. In this mode, heat exchanger 11 would serve as the condensing heat exchanger in heating modes and the evaporating heat exchanger in cooling modes. Conversely, heat exchanger 27 would serve as the evaporating heat exchanger in heating modes and the condensing heat exchanger in cooling modes.

Similarly, forced hot or cool air distribution to the structure 200 may be reduced, stopped, or bypassed, if only hot water production was desired. In various embodiments, the blowers 12 may be slowed or not operated in the FIGS. 1A-2B configurations, which will reduce the heat transfer in heat exchanger 11 and the flow of air through the ductwork. Alternatively, the heat exchanger 11 may be bypassed using bypass valves (not shown).

FIG. 1A-2B embodiments include several elements that make the double hybrid heat pump more efficient and easier to install than prior art units. For example, heat introduced by the compressor 1 may be extracted via the condensing heat exchanger 3, which may have a pump that is installed proximate the heat exchanger 3 or the tank 36. The heat exchanger 3 may be sized to achieve a range of operational scenarios. For example, in various embodiments, the heat exchanger 3 may be sized to transfer the heat from the refrigerant until the refrigerant is ~100% liquid at a pressure and temperature that is very close to the temperature of the incoming fluid, recognizing that heat transfer performance tends to vary over the life of a heat exchanger. For example, the heat exchanger 3 may be designed to have a small approach temperature, so that the temperature of the water leaving the heat exchanger at port 34 and the temperature of the refrigerant entering the heat exchanger 3 at port 2 will be within a few degrees, e.g., 3, of each other under full load conditions.

In addition, the blower speed, and hence the amount of heat transferred in refrigerant-air heat exchanger 11 may be modulated based on a feedback loop to target a specific final refrigerant temperature. Since much of the heat from the refrigerant has already been removed by the condensing heat exchanger 3, the blower 12 may be operated at lower speeds, so to not blow a large volume of air into the building which may be unpleasant to the occupants. The blower 12 may be set to cool the refrigerant to a pre-determined temperature above the incoming air temperature. For example, if the incoming air temperature is 60 degrees and the refrigerant saturation temperature is 120 degrees and the predetermined setpoint is 15 degrees above the entering air temperature, the blower 12 would modulate to set the leaving refrigerant temperature at port 13 to be 75 degrees (60+15), yielding 45 degrees of subcooling from the discharge saturation temperature.

The effect of using a subcooling heat exchanger, (heat exchanger 11 when heating and heat exchanger 27 when cooling) is significant. The extra subcooling improves the overall efficiency of the refrigeration cycle by putting a larger load on the evaporator. Furthermore, since the subcooling is done by the subcooling heat exchanger, the pressure and temperature of the refrigerant entering the condensing heat exchanger can be lower, lowering the work done by the compressor.

A similar effect happens in the evaporator. When the high-pressure refrigerant is subcooled by a colder fluid in the refrigerant cooling heat exchanger the refrigerant passes through the expansion device with less residual heat. As a result, the expansion device will throttle less and allow the refrigerant pressure to rise, increasing efficiency and decreasing the compressor power input.

Performance data collected from experimental testing shows that 30 degrees of additional subcooling improves heat extraction by the evaporator heat exchanger 27 by between 21-30%. In addition, this increase in performance also reduced compressor power consumption by 3%.

The inclusion of the water storage tank 36 may provide several benefits compared to prior art systems depending upon the deployment scenario. For example, the double hybrid heat pump system 50 including the tank 36 may:

1. eliminate the need for a contractor to size and purchase a separate buffer tank, therefore reducing project cost and complexity.
2. operate at different flow rates between the heat pump hot water condenser and the building load pump. Prior art heat pumps that do not use variable speed compressors have a manufacturer's recommended minimum flow rate, typically in the range of 3 gallons per minute per ton. This flow rate may be challenging for many buildings, as a 5-ton system would require a minimum of 15 gallons per minute to flow through the system. This flowrate is very high for homes with existing boilers, which are accustomed to low flowrates and high differential temperatures. The result is that large pumps are used to meet the minimum flowrate, but the water is split between the structure 200 and a buffer tank.
3. soften the load fluctuations on the compressor without the use of variable frequency drive ("VFD") components which add a huge amount of cost and complexity.
4. provide for thermal storage in the system, e.g., a 50-gallon tank may be used to store approximately 25,000 BTUs.
6. allow seamless integration between hydronic electric backup heat via resistance element 44 and the heat pump. This reduces the risk that an error by an installing contractor that would lead to the underuse of the heat pump.
7. allow for an indirect hot water heat exchanger to be used for domestic hot water pre-heat in the case where the tank is filled with hydronic water. In this example, the secondary benefit is that a double wall heat exchanger is not needed as there are 2 mediums between the refrigerant and the domestic water.
8. allow a large portion of the heat that would otherwise be wasted to be captured during heating and cooling operation. In cooling mode, this heat may be utilized for domestic hot water, such as by the indirect heat exchanger 41. If the heat pump is operating in cooling mode, the structure 200 may benefit from "free hot water" i.e., hot water as a byproduct of cooling, by recovering it in the storage tank 36 rather than a traditional air conditioning system which rejects the heat outside by a condenser unit. Also compared to most geothermal systems, which use a desuperheater for domestic hot water, this system may be capable of recovering 90% or greater of the heat normally rejected compared to only the superheat (typically less than 15% of the total). In both heating and cooling mode, the heat added by the compressor 1 first goes to this tank and may be used as needed with limited additional mechanical equipment (no additional mechanical equipment is needed to provide domestic hot water.)
9. allow a heat pump controller to sense the building load by the change in temperature without the sudden swings in the refrigerant pressure that would be caused by directly piping the hot water return to the heat pump.

FIGS. 2A & 2B depict a double hybrid refrigeration cycle, as previously described, but with only a single reversing element 15. A disadvantage of the single reversing element 15 is that in one mode of operation, usually the cooling mode, the refrigerant must go concurrent flow with the source/sink loop, if employed. However, this configuration may still be preferable to other prior art, since it still allows for refrigerant subcooling in both heating and cooling mode.

The Double Hybrid system 50, as previously described, has several advantages for retrofitting residential structures that have existing hydronic heating infrastructure. These buildings may have hydronic heat emitters, typically baseboards, radiators or radiant floors, that were sized at the time of installation based on higher temperature hot water; i.e., the 160-180 degrees that is a common supply temperature of a conventional boiler. These same heat emitters may have only a fraction of their original capacity when connected with supply water that is at a temperature typical of a heat pump system (110-120 degrees).

The double hybrid heat pump 50 may be configured to produce hot water for the hydronic systems and hot air for heating at the same time, from the same unit to overcome the heat deficiency created by using lower temperature water in the hydronic system. As previously described, by producing these two at the same time, the efficiency is greatly improved and the warm air can be used to supplement the heat emitters in a retrofitted building.

In addition, the double hybrid system 50 has further advantages in terms of overall system efficiency compared to prior art hot water only heat pumps. For example, a building that could be heated on a peak day with 120 degree hot water would require that the hot water only heat pump to deliver 120 degree hot water, whereas the double hybrid system 50 may be operated with a lower hot water temperature, for example to 100 or 110 degrees, and then supply heated forced air at the same time to provide the same total heating effect to the building. The skilled artisan will appreciate that a lower supply temperature of even a few degrees makes a large difference on heat pump efficiency. For example, a 10 degree reduction in supply temperature may increase the coefficient of performance by 0.25.

In addition, if the building's heat emitters were severely limiting, the unit could cycle between producing only hot air and both hot air and hot water to ensure that the heat production of the unit is not limited by the capacity of the heat emitters in the building.

The skilled artisan may employ other devices in the system 50. For example, a desuperheater may be employed between the compressor 1 and the condensing heat exchanger 3, to pre-cool the high-pressure, high temperature vapor prior to entering the condensing heat exchanger 3.

Figure 3A:
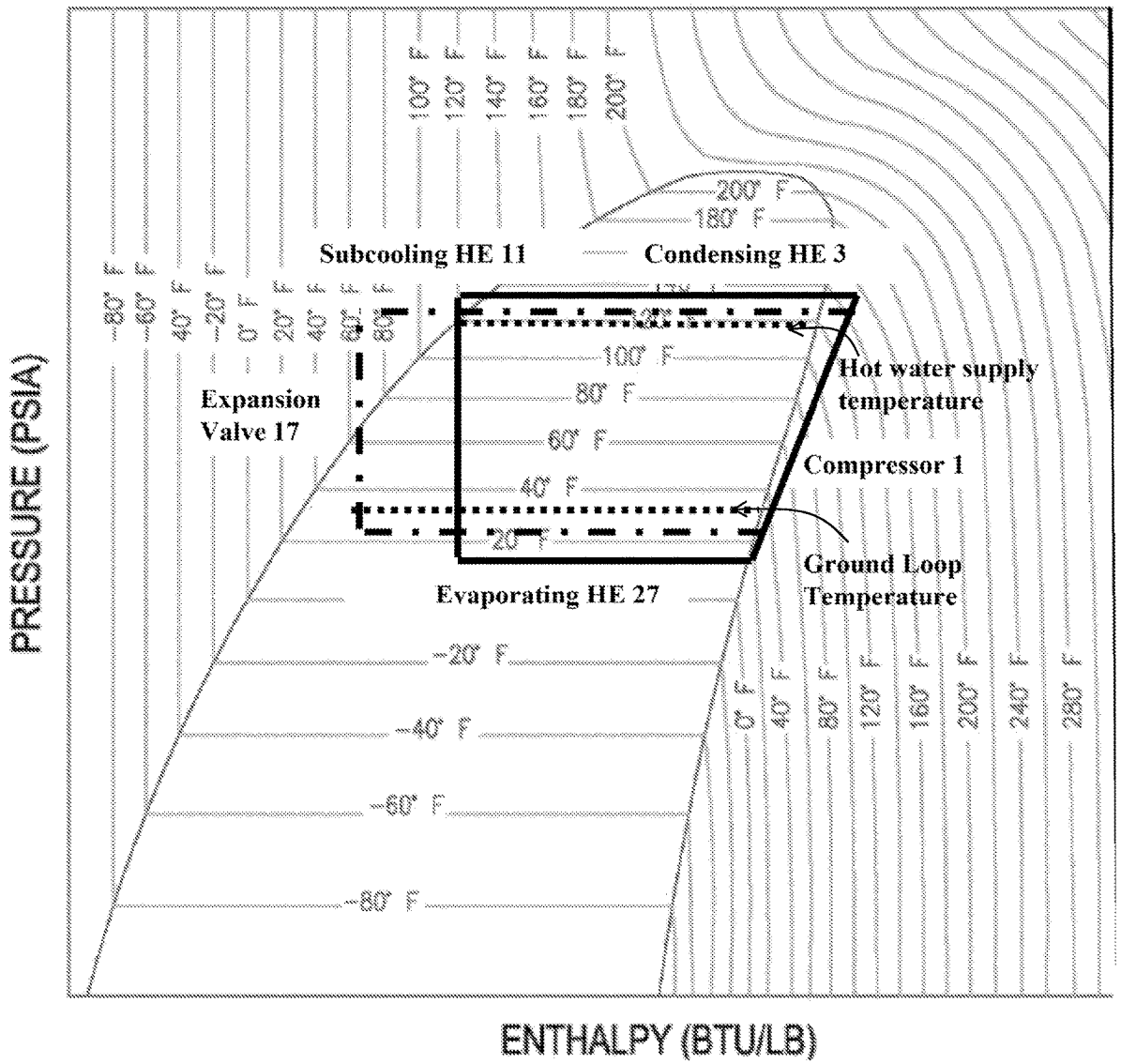
FIGS. 3A & 3B show exemplary refrigeration heating and cooling cycles, respectively, in terms of pressure versus enthalpy for the prior art and present invention.
Figure 3B:
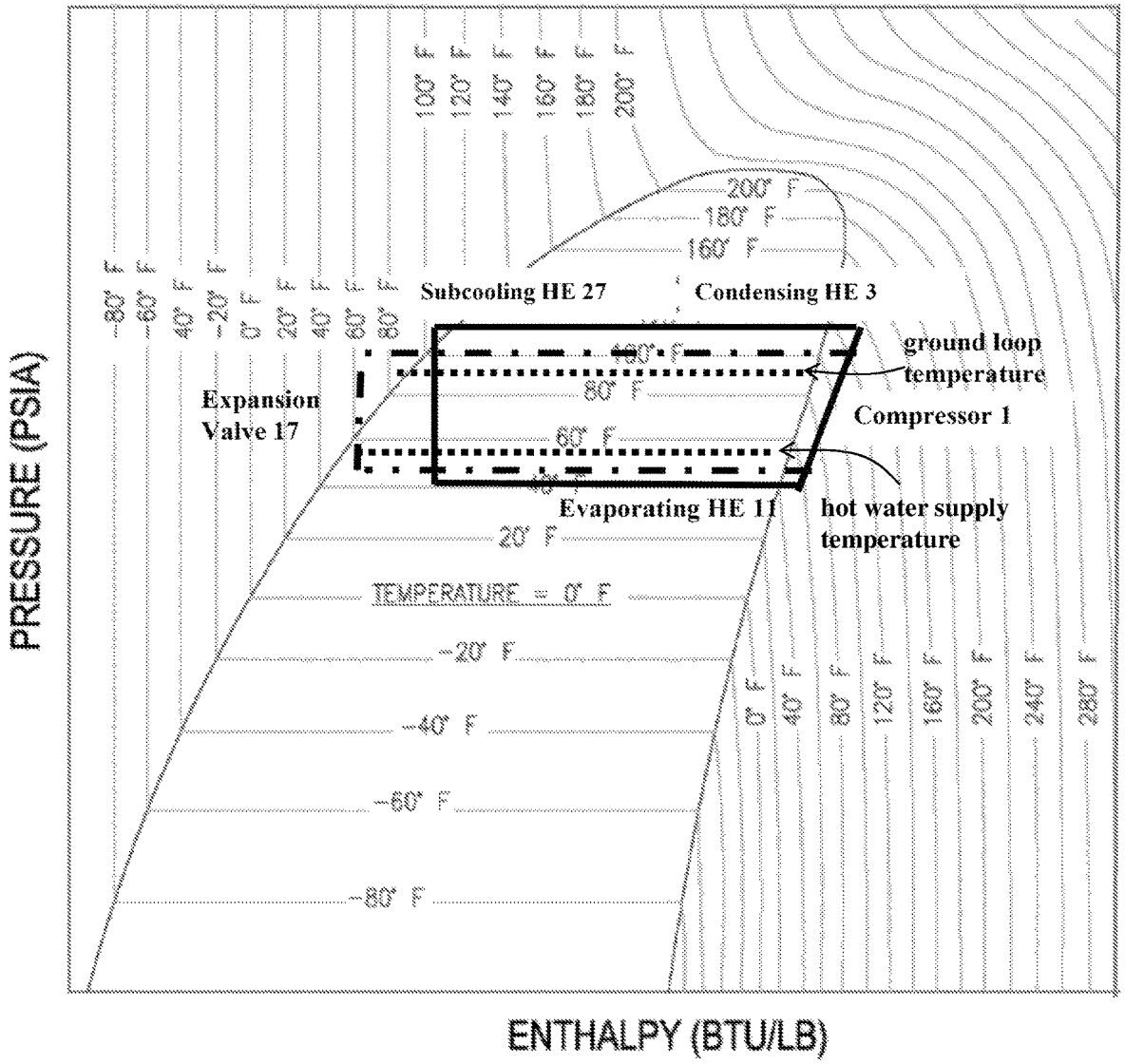
Figure 4A:
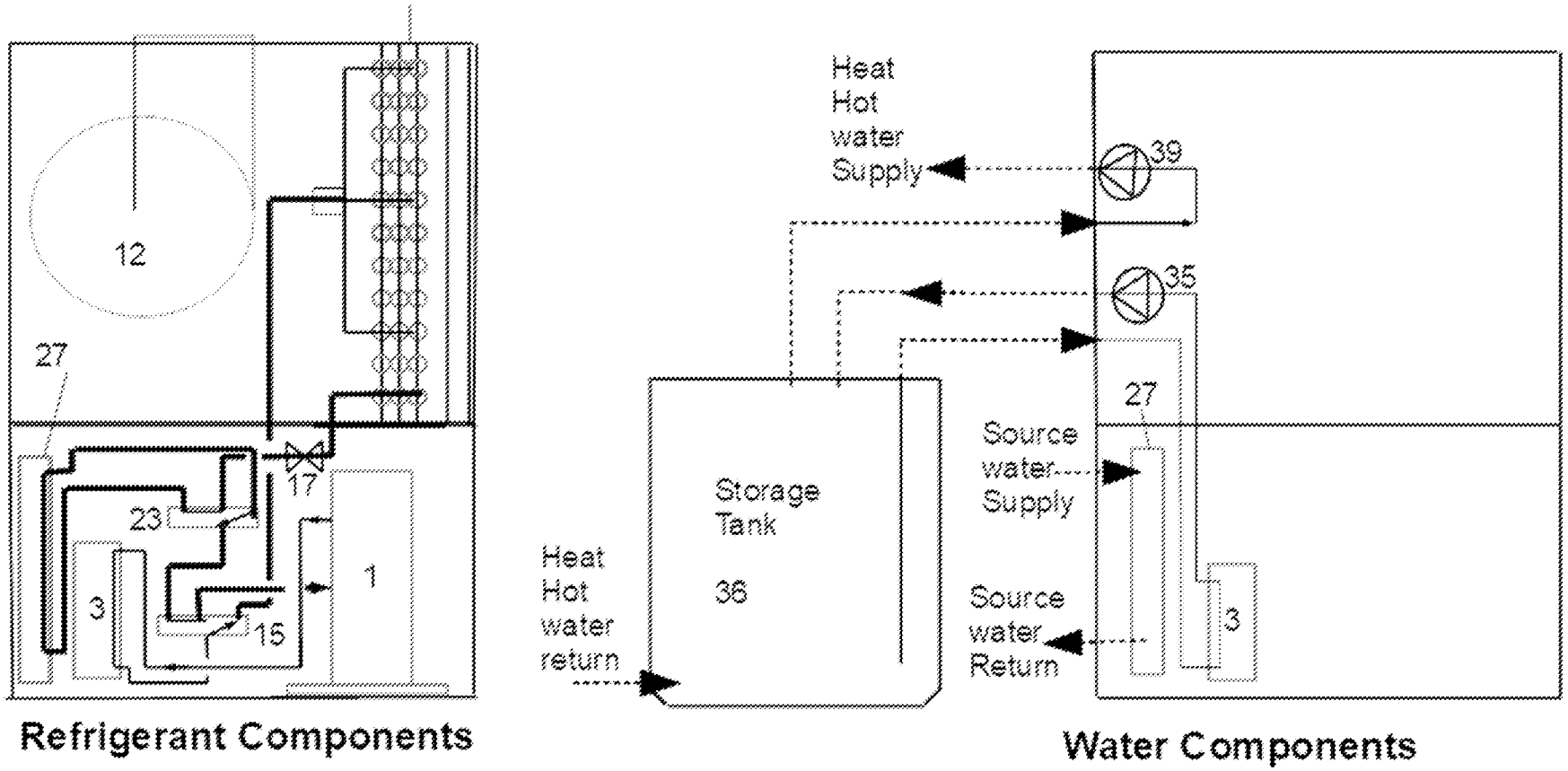
FIGS. 4A-4D depict exemplary embodiments of the DHHP in which the refrigerant portion and water portion are shown separately for ease of viewing.
Figure 4B:
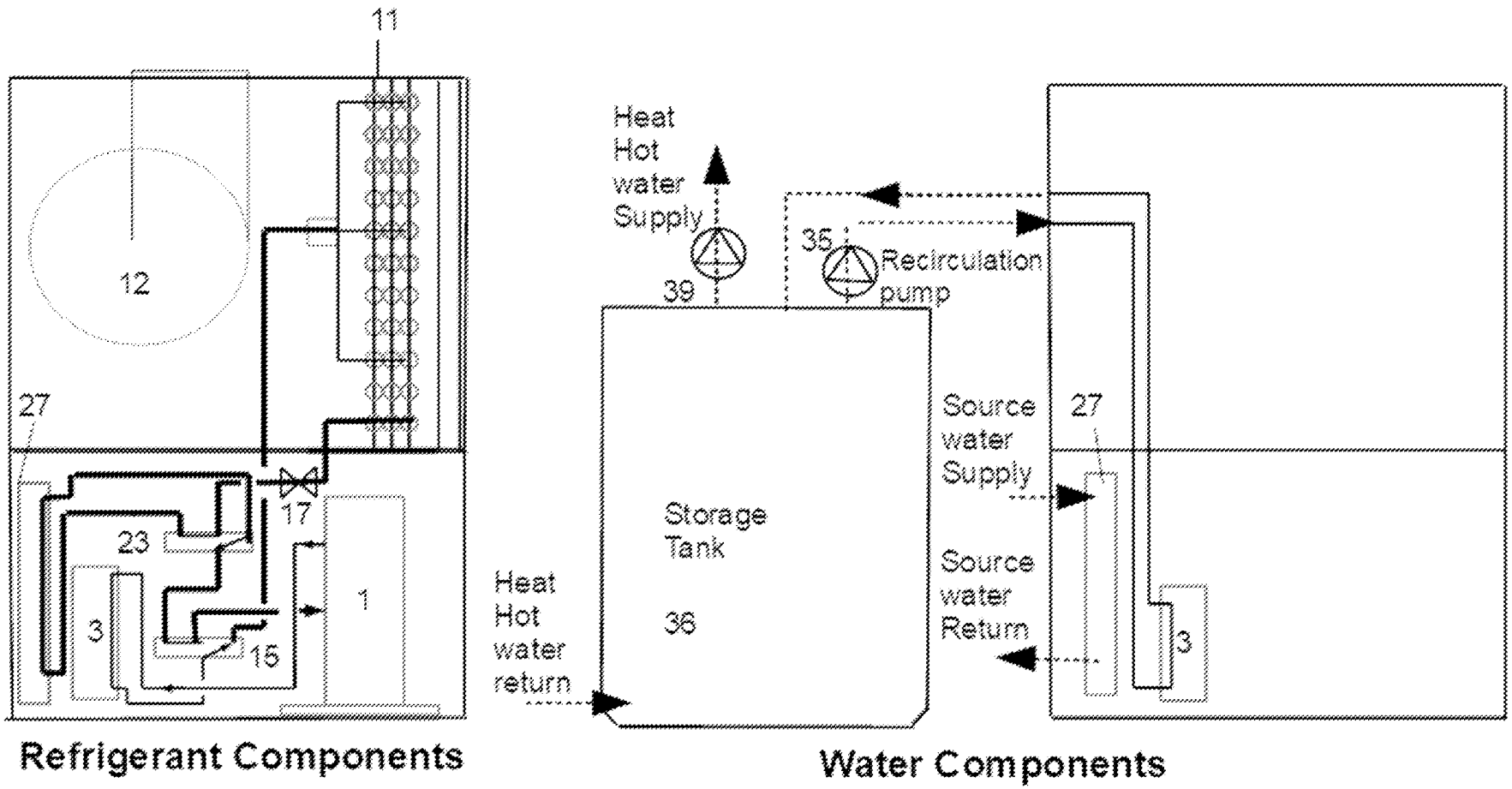
Figure 4C:
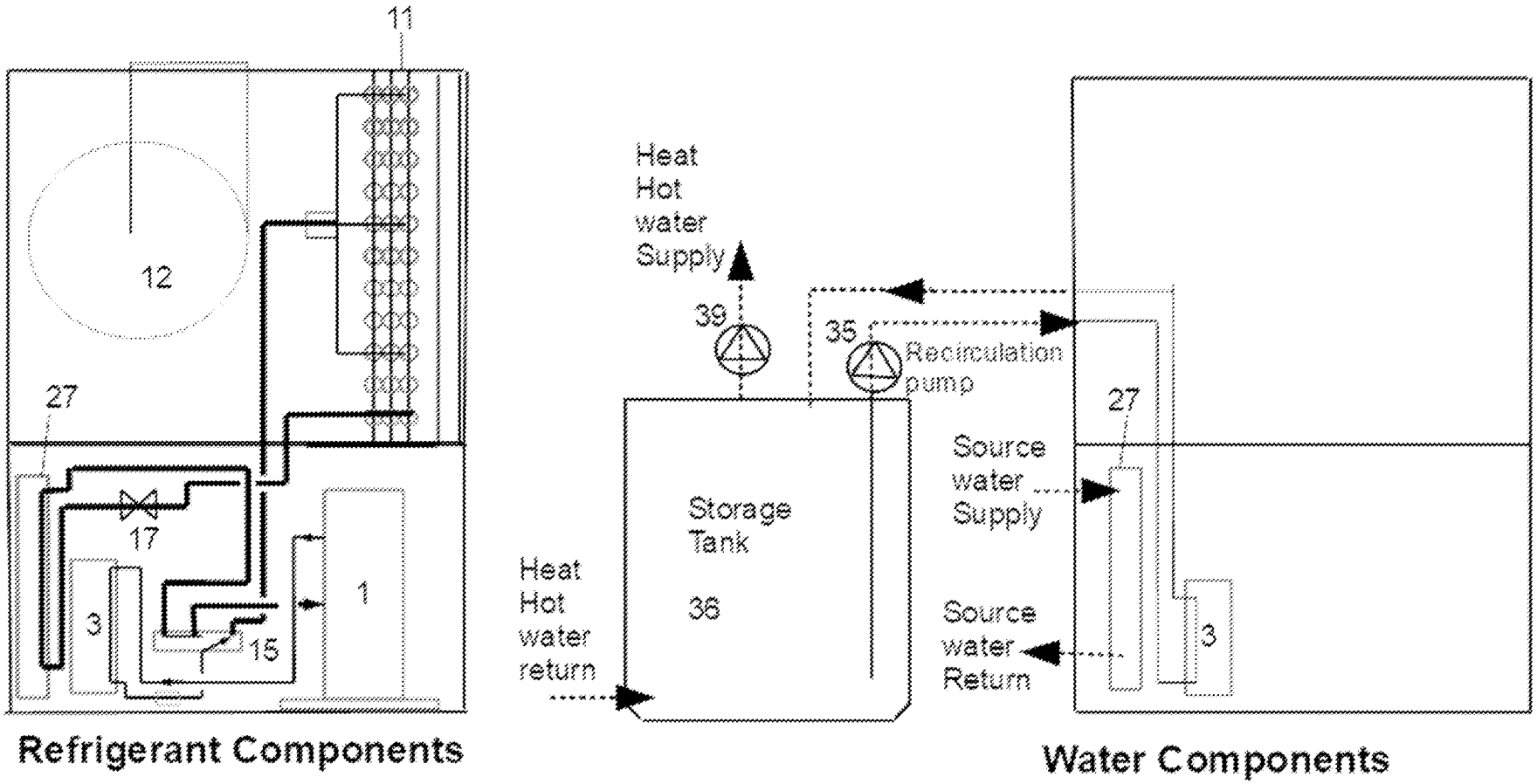
Figure 4D:
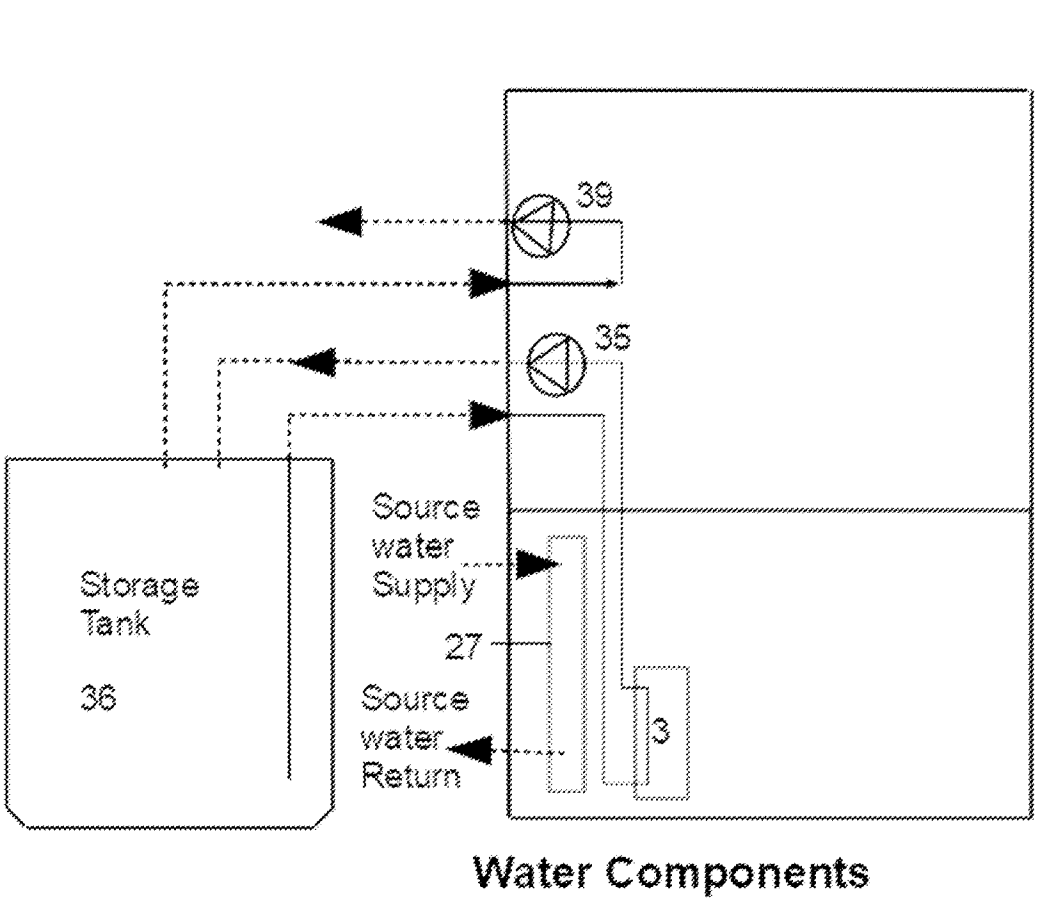
Figure 4D:
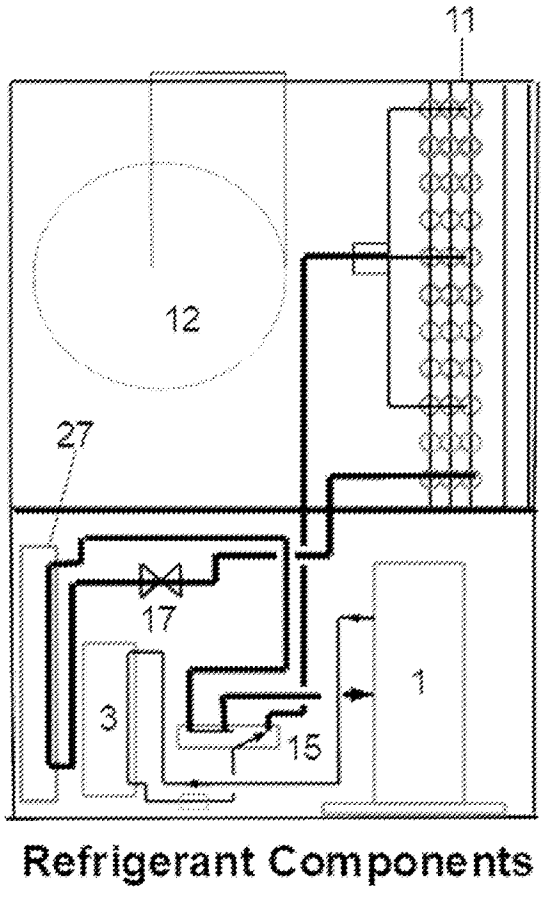

FIGS. 3A & 3B show exemplary refrigeration heating and cooling cycles, respectively, in terms of pressure versus enthalpy for the prior art and present invention. The solid black line is a standard prior art water to water heat pump system and dashed-dot purple lines show the refrigeration cycle with subcooling and condensing heat exchangers. The greater width of the refrigeration cycle in FIGS. 3A and 3B is due to the subcooling heat exchanger (HE), which provides additional heat transfer from the refrigerant after leaving condensing heat exchanger 3. The net effect created is a refrigeration cycle that has a larger refrigeration effect with lower compressor work, resulting in higher efficiency. One of ordinary skill in the art will appreciate that the refrigerant leaving the condensing heat exchanger 3 which is passed to the cooling heat exchanger, and the refrigerant exiting the expansion valve 17 may be 100% liquid or a two-phase mixture as desired. In exemplary cycle 3B, the condensing heat exchanger 3 absorbs the latent heat from the high-pressure fluid and then subcooling heat exchanger 27 further cools the refrigerant within a few degrees of the ground loop temperature.

FIGS. 4A-4D depict exemplary embodiments of the DHHP 50 in which the refrigerant portion and water portion are shown separately for ease of viewing. FIGS. 4A-4B and 4C-4D show refrigerant and water portions for embodiments similar to the FIGS. 1A & 2A embodiments, respectively, in a heating mode configuration with different arrangement of the circulation pumps 35 and 39.

Though the use of two circulator pumps is not necessary, including them in a packaged product does provide several advantages, such as:

1. Faster and easier installation for the installing contractor, reducing onsite piping and simplified wiring.
2. Providing a flow of water from the heat pump to the building hydronic hot water supply.
3. Easier to adjust of supply pressure and flowrate and therefore easier adaption to the majority of homes
4. Variable speed circulators may be controlled by the DHHP, which further simplifies the control integration for the installer and minimizes integration issues with existing systems.
5. The circulators may be turned off to allow a larger percent of the heat to be released by forced hot air, if desired, such as when auxiliary heat is turned on.

The present invention reduces installation time and cost by reducing the need for extensive ductwork, complex controls, hydronic air handlers, buffer tanks, additional circulators or any other external equipment to operate.

Figure 5:
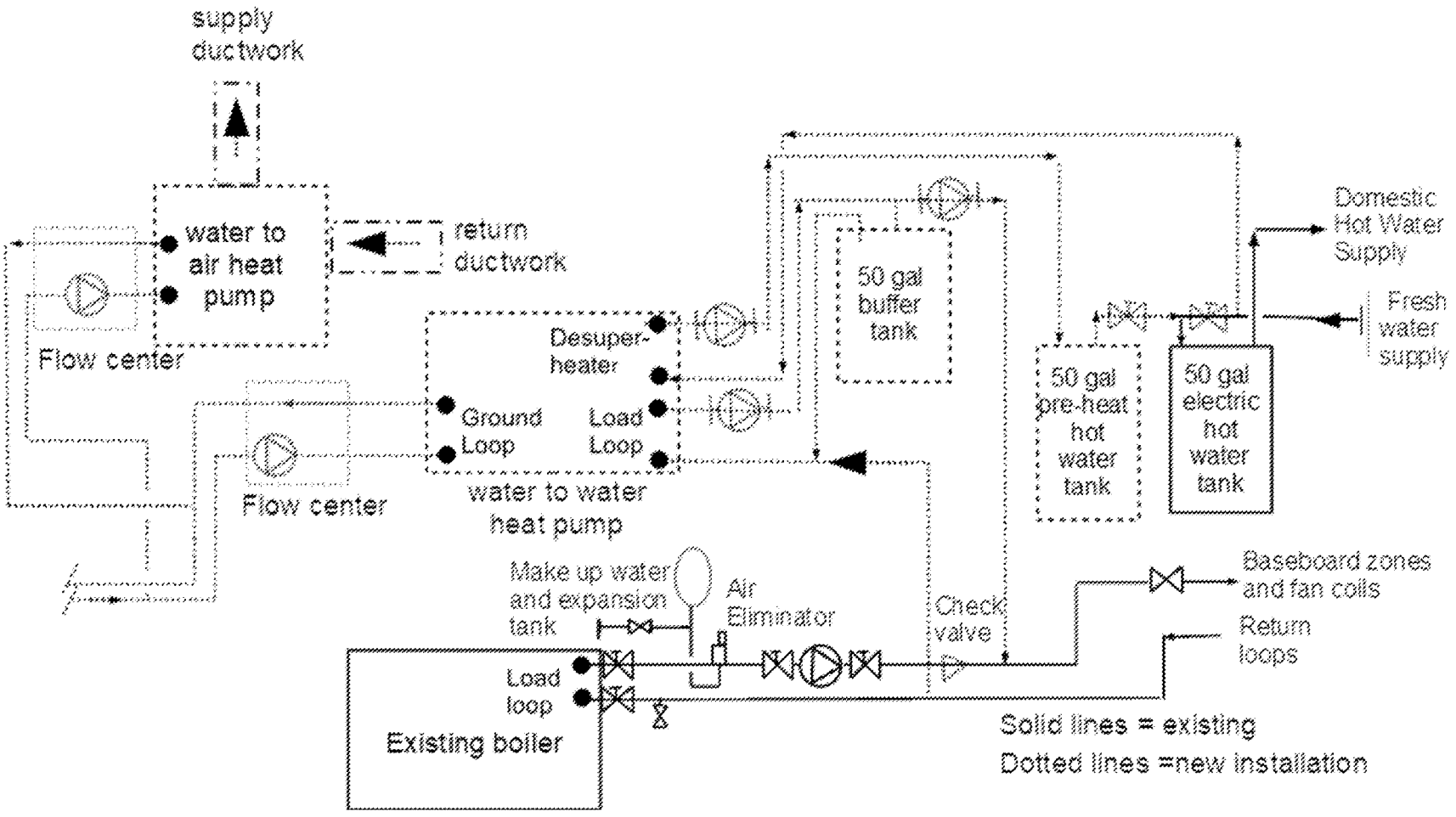
Prior Art FIG. 5
FIG. 5 shows an exemplary geothermal retrofit using the prior art systems and methods.
Figure 6:
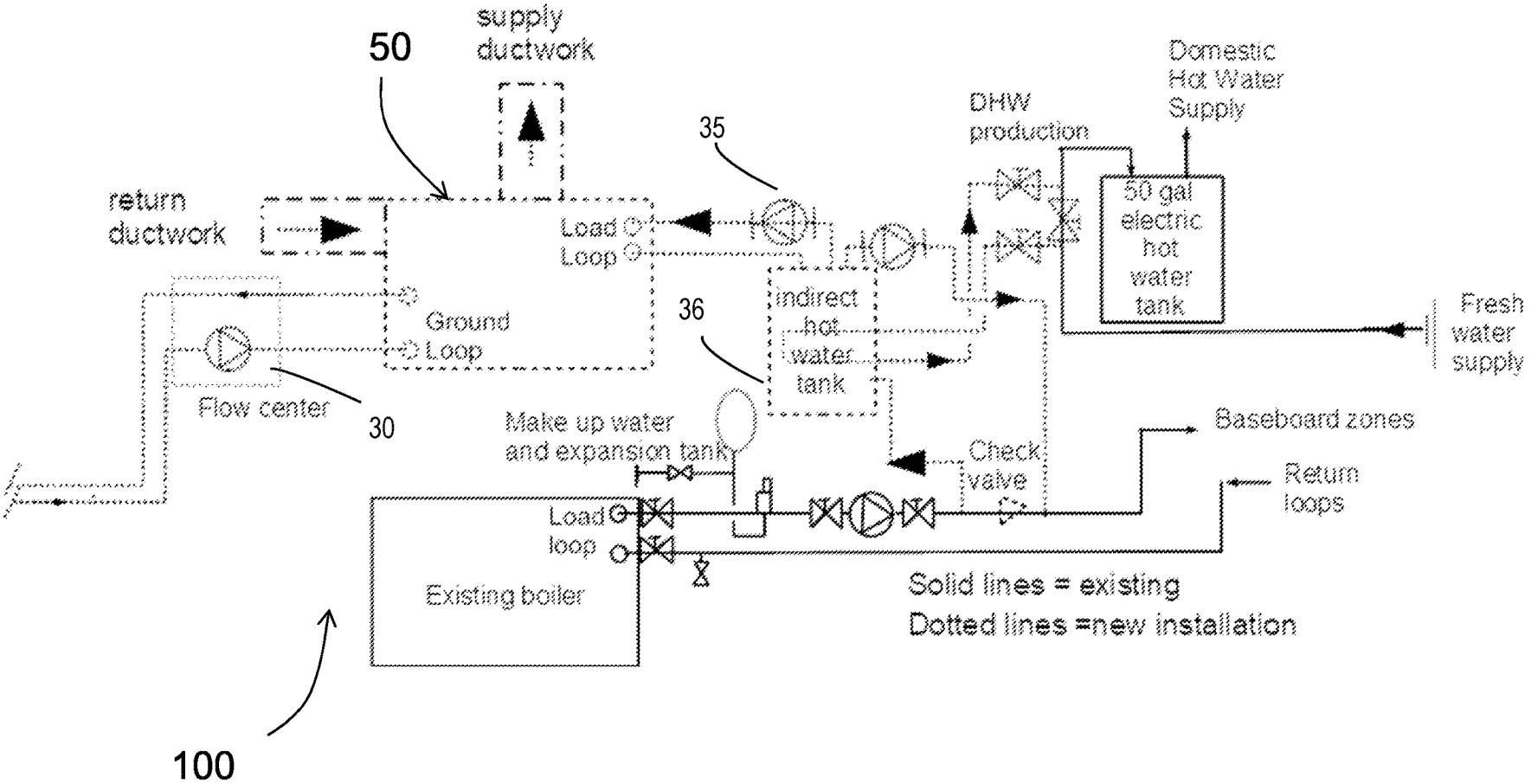
FIG. 6 shows an exemplary geothermal retrofit using the present invention.

FIGS. 5 & 6 provide a comparison of a building assessed for a geothermal retrofit using the prior art methods (FIG. 5) and the present invention (FIG. 6). The existing system may include a boiler and a domestic hot water tank.

Using prior art methods, the refit may involve the installation of:

1. a water-to-water heat pump to provide hot water for heating and domestic use;
2. a water to air heat pump to provide hot and cool air for forced air heating and cooling;
3. a water buffer tank;
4. flow controllers for the two heat pumps; and
5. two water circulator pumps and associated plumbing to connect to the existing boiler and hot water tank.

Prior art installation such as shown in FIG. 5 may cost in a range about $70,000-100,000.

By contrast, the same retrofit with a Double Hybrid heat pump (FIG. 6), may be performed in a range about $50,000-60,000 before incentives, due to the elimination of one heat pump, a domestic hot water pre-heat tank, one circulator pump, several fan coils and a flow controller from the design and the associated cost. As one skill in the art will further appreciate, systems 100 employing the DHHP 50 will likely reduce maintenance and troubleshooting costs associated with the installed system.

Figure 7A:
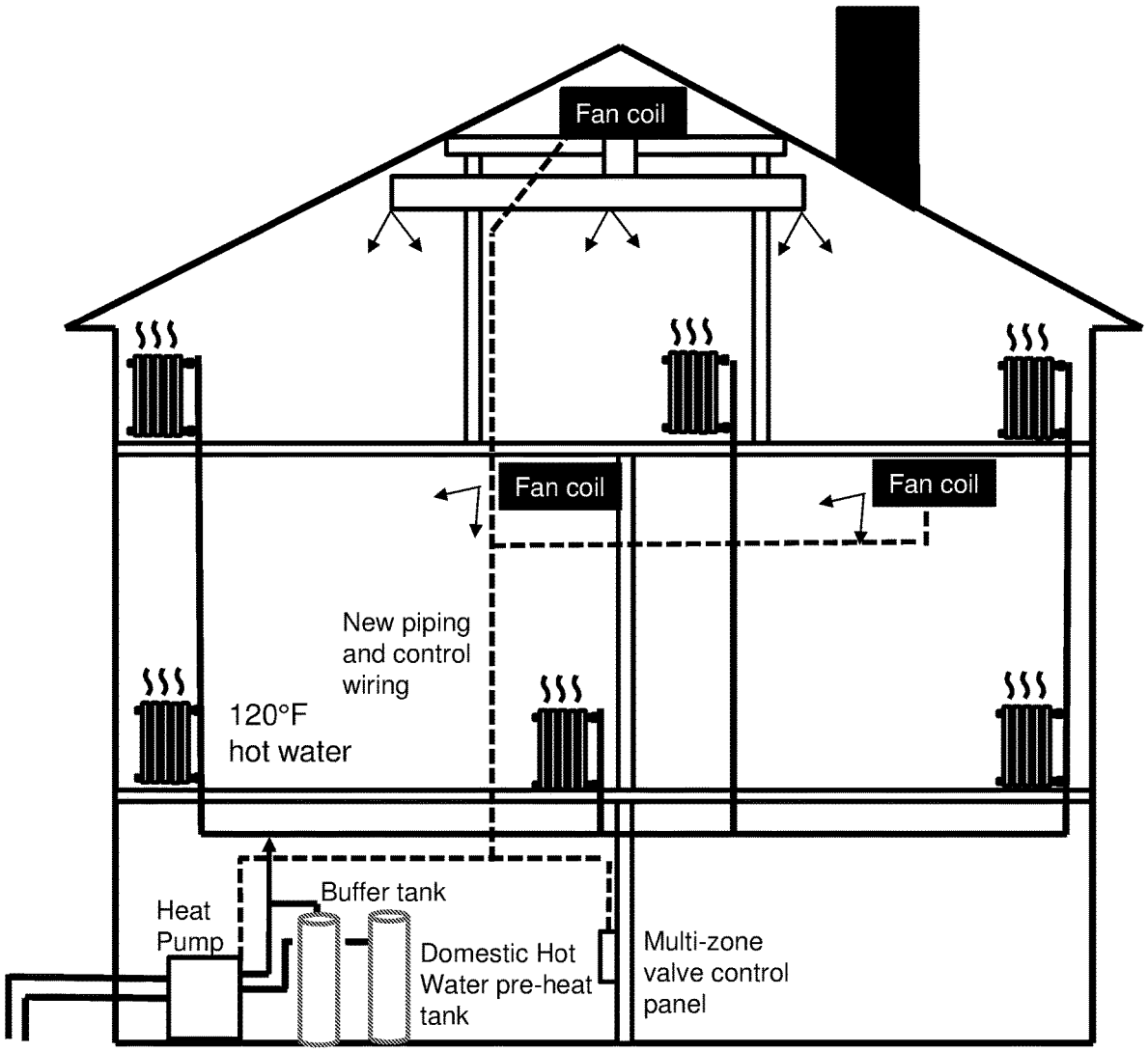
FIG. 7A Prior Art
FIGS. 7A-7C show exemplary geothermal retrofits using the prior art systems and methods of the present invention.
Figure 7B:
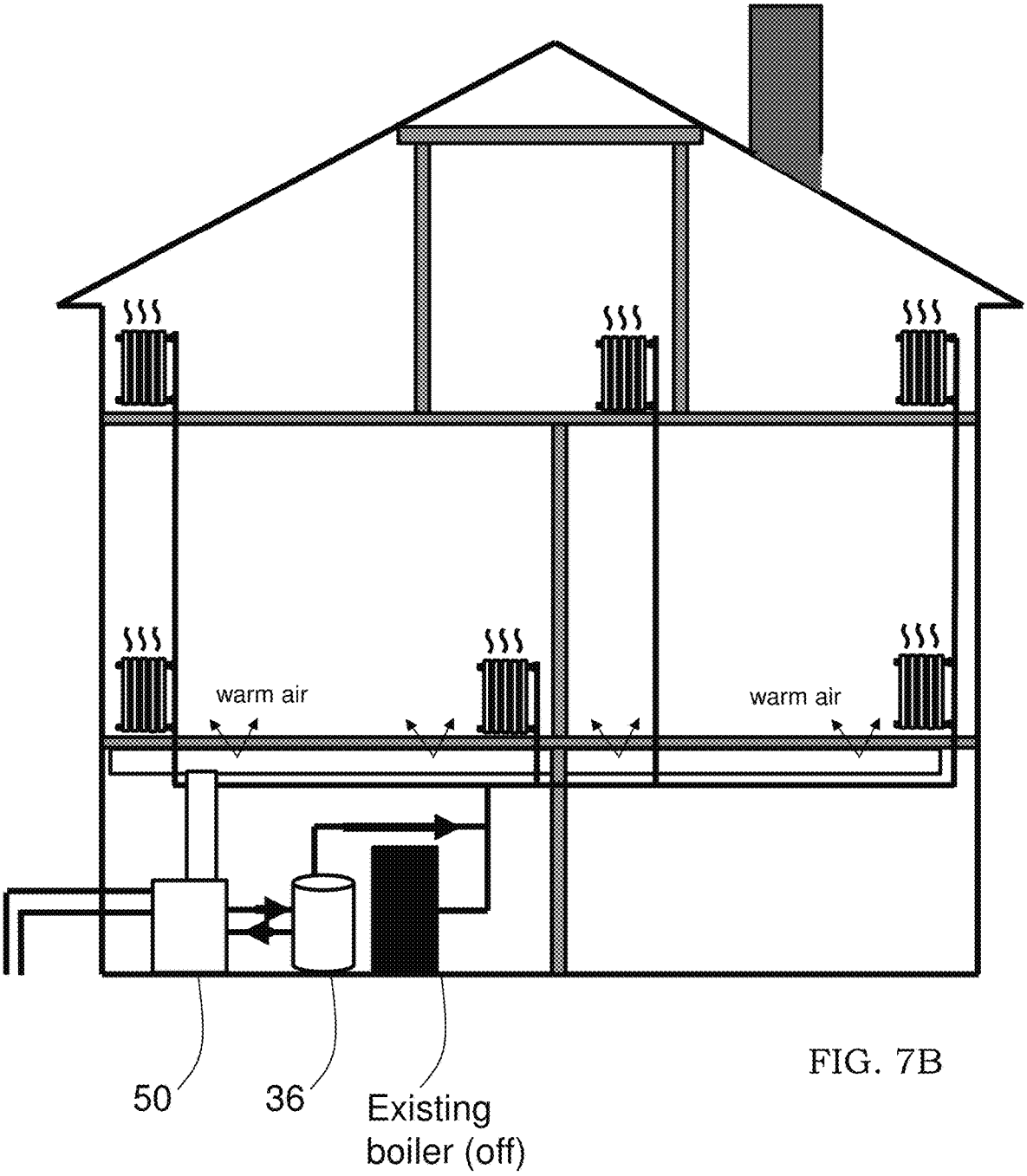
Figure 7C:
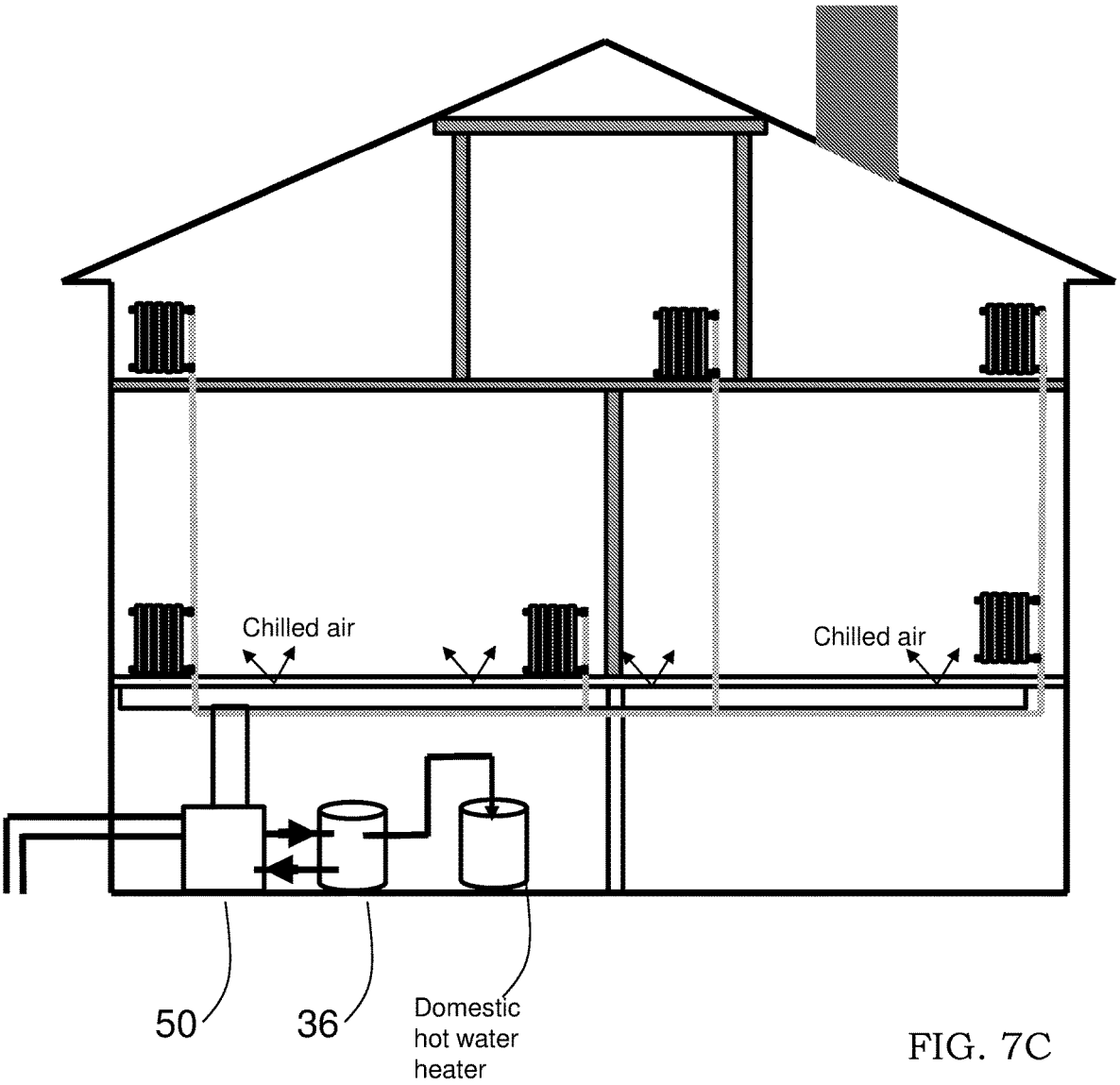

FIG. 7A shows a typical prior art retrofit of a boiler based heating system with a conventional heat pump. FIGS. 7B & 7C depict various embodiments of the system 100 with a DHHP 50 installed in a structure 200 in the heating (7B) and cooling (7C) modes, respectively. FIG. 7B shows the flow of heat in the structure 200 in the heating mode and provides exemplary use cases. As previously discussed, and shown in FIG. 7B, the system 100 with a DHHP 50 provides hot water to the boiler, or in lieu of the boiler, to support hot water heating and forced hot air for additional heating. While FIG. 7B shows ductwork and forced hot air being provided to the first floor only, one of ordinary skill will appreciate the ductwork may be provided to the higher floors as desired to meet design and budget objectives.

FIG. 7C shows the flow of cool air in the structure 200 in the cooling mode and the provision of hot water for domestic hot water uses. These embodiments are particularly efficient as the heat is removed from the air in the structure 200 may be used to heat water for domestic hot water use.

While the present invention was described in various embodiments as being used in combination with a boiler, unlike prior art units, the DHHP 50 of the present invention may be used to replace an existing boiler. The integration of the refrigerant subcooling function may enable substantially higher coefficients of performance (COP), such as 3.5-4.5 in regular heating mode and up to 8-12 in cooling mode (accounting for the hot water benefit) compared of COP of between 2.8-3.2 in heating mode and 4.5-6 in cooling mode that is typical of water to water heat pumps with a desuperheater. In addition, system 100 employing the DHHP system 50 of the present invention are simpler to install resulting in a lower risk of job failure or recall for the contractor.

One of skill in the art will appreciate that the system 50 may be implemented with fixed or variable speed pumps and blowers 12 to provide flexibility in the operation and control. For example, the system 50 may employ variable speed blowers 12, which typically have a lower parasitic electric load than multiple small single speed fans that may be used by hydronic air handlers and more flexibility than one fixed speed fan. Likewise, one more pumps 30 and 35 in the system 50 may be variable speed.

Figure 8:
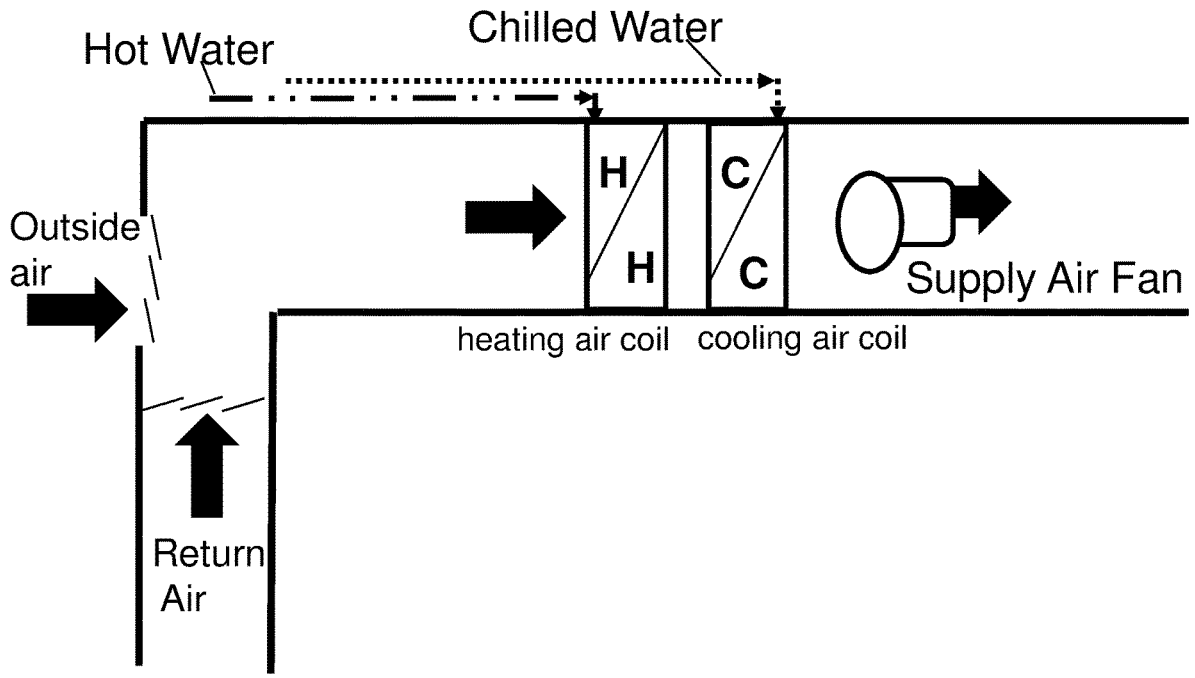
FIG. 8 Prior Art
FIG. 8 depicts an exemplary commercial air handler.

FIG. 8 depicts a typical air handling unit, which would typically use hot water from a boiler and chilled water from a chiller to provide hot and cool air, respectively, to a structure.

Figure 9:
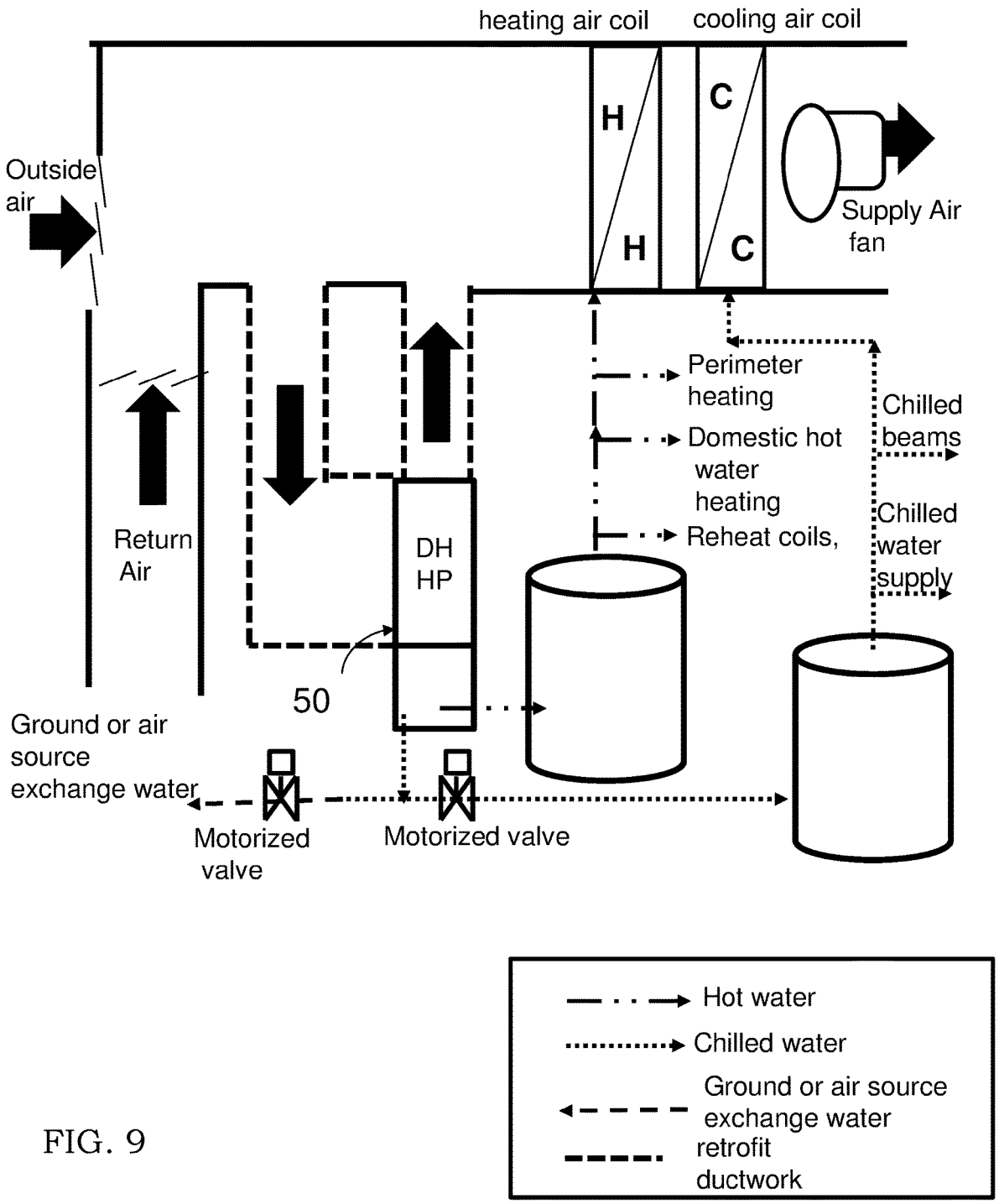
FIG. 9 depicts exemplary embodiments of how a double hybrid heat pump could be retrofitted into an exemplary commercial air handler.

FIG. 9 shows how an air handler could be retrofitted with a commercial sized double hybrid heat pump system 50. There would be several advantages to this approach. First, if the building has simultaneous heating and cooling loads, which are common in many commercial buildings, hospitals, factories, universities and other situations, the DHHP system 50 may produce hot water, hot air, and chilled water at the same time. For example, if the building has a need for heating, the double hybrid could produce high temperature hot water, for example 120 degrees, that could be used within the building for a number of uses, including heating the air handler heating coils. The refrigerant would then be further subcooled by the incoming air handler air, which is presumed to relatively cold and the act of further cooling of the refrigerant serves to preheat the air before it reaches the first air coil. The now subcooled refrigerant would pass through the expansion valve and absorb heat from a water supply. If the building needed chilled water, the return chilled water may be used for the refrigerant evaporator, or if there was no longer a need for chilled water, a ground, air, or other source method of heat exchange, such as a geothermal borehole or dry cooler may be employed.

One advantage of the DHHP system of the present invention is that it releases more heat by using the integrated air coil to subcool the refrigerant, as previously described on FIG. 1A. In residential applications, the unit must be attentive to the discharge air temperature, so to avoid a "cold blow" sensation to the homeowners. However, in a commercial/industrial retrofit application, as described in this example, the air is pre-heating the air entering the air handler and so this is less of a concern.

In addition, compared with prior art systems that employ modular, water to water heat pumps, the double hybrid heat pump of the present invention is able to achieve significantly higher efficiency for 2 reasons. 1. The DHHP widens the refrigeration cycle by subcooling the refrigerant, producing more net heating and cooling effect while using less electricity. 2. When heating or cooling, the approach temperature of the refrigerant to air heat exchanger will be favorable to the transferring through 2 heat exchangers. For instance, in cooling mode, the DHHP system 50 could receive 80 degree air and cool it with approximately 50 degree refrigerant. However, a hydronic heat pump would need to make 50-degree chilled water, and this would require the refrigerant to be even colder, perhaps 30-35 degrees. As is well known by those familiar with the art, the lower temperature refrigerant would be less efficient because the compressor will need to work harder to compress the lower pressure refrigerant to high-pressure.

The DHHP system 50 may be designed in a modular fashion, to conserve space, reduce transportation challenges and allow the units to be combined onsite in a cascade fashion to ramp up and down depending on the varying building requirements.

For example, if the building had a need for cooling the air, the DHHP systems 50 may condense the high-pressure refrigerant into a liquid in the first heat exchanger, providing useful heat for purposes such as domestic hot water, and then would use the reversing element to send the refrigerant to a second heat exchanger that would be connected to a ground or air source of heat exchange for further heat rejection. If the temperature of the water entering the second heat exchanger was colder than the water that entered the first, the double hybrid can leverage the temperature difference to further subcool the refrigerant, releasing more heat from the refrigerant prior to the expansion and evaporation. After the second heat exchanger, the subcooled refrigerant enters the expansion device and becomes a low-pressure, low temperature fluid. The DHHP system 50 may use the low-pressure, low temperature fluid to pre-cool the incoming air prior to it reaching the first heating air coil.

Figure 10:
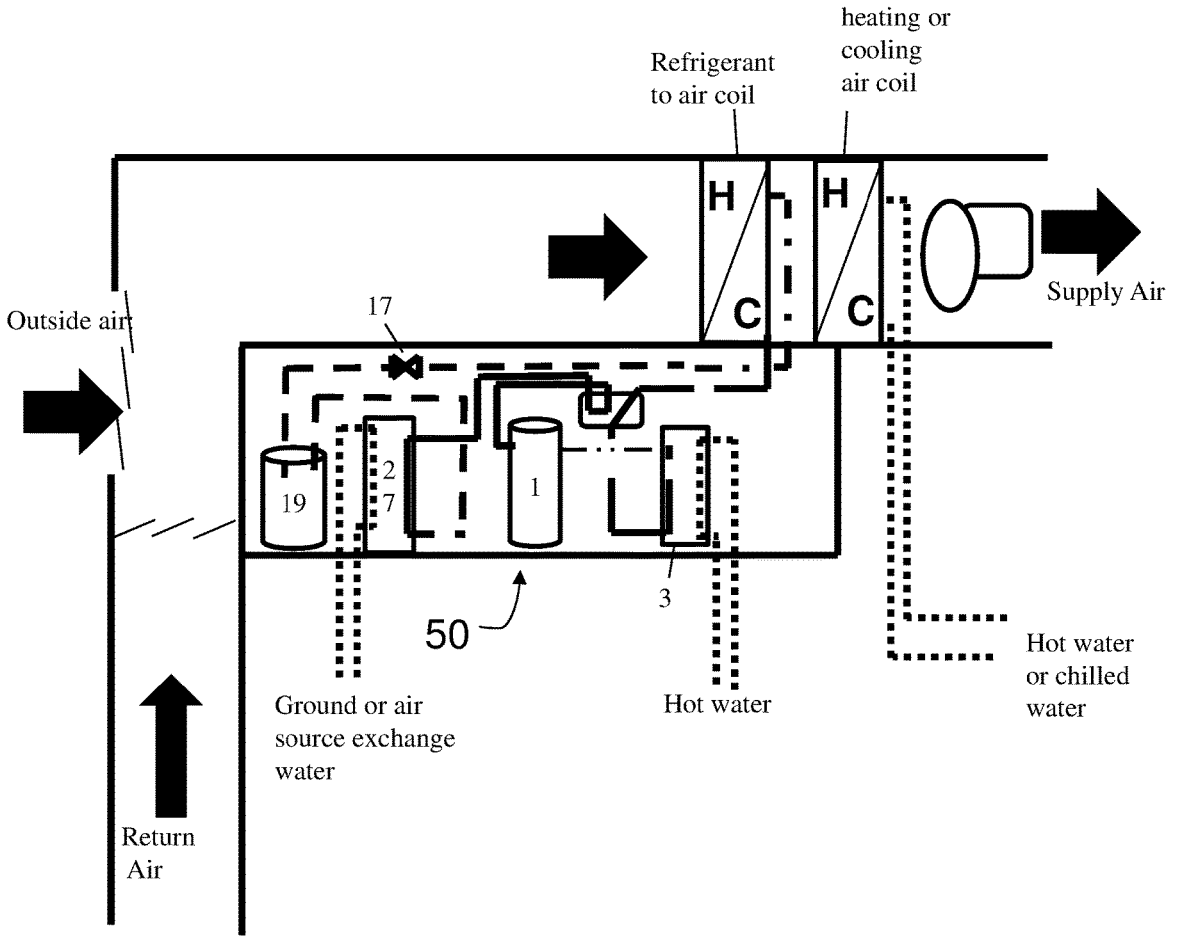
FIG. 10 depicts exemplary embodiments of how a double hybrid heat pump could be built as a commercial air handling unit.

FIG. 10 shows an example of a double hybrid heat pump that is directly integrated into a commercial or industrial air handler. This could be used for new construction or to replace existing equipment. In this example, in multiple embodiments the components used in FIG. 1A-2B could be integrated into a commercial or industrial unit for the production of high efficiency heating and cooling. These could be used in a modular arrangement or standalone. In some cases, the system 50 may include hot or chilled water storage.

The foregoing disclosure provides examples, illustrations and descriptions of the present invention, but is not intended to be exhaustive or to limit the implementations to the precise form disclosed. Modifications and variations are possible in light of the above disclosure or may be acquired from practice of the implementations. These and other variations and modifications of the present invention are possible and contemplated, and it is intended that the foregoing specification and the following claims cover such modifications and variations.

As used herein, the term component is intended to be broadly construed as hardware, firmware, and/or a combination of hardware and software. It will be apparent that systems and/or methods, described herein, may be implemented in different forms of hardware, firmware, or a combination of hardware and software. The actual specialized control hardware or software code used to implement these systems and/or methods is not limiting of the implementations. Thus, the operation and behavior of the systems and/or methods were described herein without reference to specific software code—it being understood that software and hardware can be designed to implement the systems and/or methods based on the description herein.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" and the term "set" is intended to include one or more items and may be used interchangeably with "one or more". Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A heat pump system comprising:

a compressor having a low-pressure vapor refrigerant inlet and a high-pressure vapor refrigerant outlet, the compressor configured to compress a low-pressure vapor refrigerant passing from the inlet to the outlet of the compressor into a high-pressure vapor refrigerant;

a refrigerant condensing heat exchanger having an inlet connected to the high-pressure vapor refrigerant outlet of the compressor and an outlet, the condensing heat exchanger configured to condense high-pressure vapor refrigerant passing from the inlet to the outlet of the condensing heat exchanger and exchange heat from the refrigerant to heat water for at least one of heating and domestic use;

a refrigerant cooling heat exchanger having an inlet connected to outlet of the condensing heat exchanger and an outlet, the cooling heat exchanger configured to condense high-pressure vapor refrigerant and further cool the high-pressure liquid refrigerant passing from the inlet to the outlet of the cooling heat exchanger;

an expansion valve having an inlet connected to the outlet of the cooling heat exchanger outlet and an outlet, the expansion valve configured to induce a pressure drop in the high-pressure liquid refrigerant passing through the expansion valve and output one of a low-pressure liquid and a two-phase vapor/liquid mixture refrigerant;

a refrigerant evaporating heat exchanger having an inlet connected to the expansion valve outlet and an outlet connected to the compressor inlet, the evaporating heat exchanger configured to at least vaporize low-pressure liquid refrigerant passing from the inlet to the outlet of the evaporating heat exchanger and provide the low-pressure vapor refrigerant to the compressor; and at least one blower to provide one of cool air from the evaporating heat exchanger when the heat pump is in a cooling mode and hot air from the cooling heat exchanger when the heat pump is in a heating mode to an outlet for cooling and heating.

2. The system of claim 1, where the water heated in the condensing heat exchanger is circulated from a water storage tank.

3. The system of claim 2, where water in the water storage tank provides heat to at least one of a supply of water for domestic use and heat a structure.

4. The system of claim 1, where the at least one blower is adjustable to control the air flow and heat transfer.

5. The system of claim 1, further comprising a first reversing element configured to reverse the refrigerant flow between a heating and cooling mode, where in the heating mode, the cooling heat exchanger is a refrigerant to air heat exchanger and the refrigerant evaporating heat exchanger is a refrigerant to source heat exchanger, and where in the cooling mode, the cooling heat exchanger is the refrigerant to source heat exchanger and the refrigerant evaporating heat exchanger is the refrigerant-air heat exchanger.

6. The system of claim 5, further comprising a second reversing element configured to reverse the flow of the refrigerant through the refrigerant to source heat exchanger.

7. The system of claim 6, where the second reversing element is configured to produce counter-current flow of the refrigerant through the refrigerant to source heat exchanger in both the heating and cooling mode.

8. The system of claim 5, where the refrigerant to source heat exchanger is one of a ground and air source heat exchanger.

9. The system of claim 1, where the refrigerant exiting at least one of the refrigerant condensing heat exchanger and the expansion valve is a two-phase mixture.

10. The system of claim 1, where the refrigerant cooling heat exchanger exchanges heat with a heat exchange media that is at a lower temperature than the water exchanging heat with the refrigerant in the refrigerant condensing heat exchanger.

11. The system of claim 1, where system is used in one of a residential, commercial, and industrial heating and cooling system.

12. A heating and cooling system for a structure comprising:

a heat pump comprising:

a compressor for compressing a low-pressure vapor refrigerant to high-pressure vapor refrigerant;

a refrigerant condensing heat exchanger, wherein the condensing heat exchanger heats water using heat exchanged from the high-pressure vapor refrigerant to output one of a high-pressure liquid refrigerant and a high-pressure two-phase vapor-liquid refrigerant, where water from the water storage tank provides at least one of hot water for heating and domestic use in the structure;

a refrigerant cooling heat exchanger to further cool high-pressure liquid refrigerant and condense high-pressure vapor refrigerant received from the condensing heat exchanger;

an expansion valve connected to the cooling heat exchanger to induce a pressure drop in the high-pressure liquid refrigerant to output one a low-pressure liquid refrigerant and low-pressure two-phase vapor-liquid refrigerant;

a refrigerant evaporating heat exchanger connected to the expansion valve to vaporize the low-pressure liquid refrigerant and provide the low-pressure vapor refrigerant to the compressor;

a first reversing element having a heating mode and cooling mode, where in the heating mode the first reversing element directs refrigerant flow from the condensing heat exchanger to a refrigerant to air heat exchanger serving as the refrigerant cooling heat exchanger and the refrigerant evaporating heat exchanger is a refrigerant to source heat exchanger, and in the cooling mode the first reversing element directs refrigerant flow from the condensing heat exchanger to the refrigerant to source heat exchanger serving as the refrigerant cooling heat exchanger and the refrigerant evaporating heat exchanger is the refrigerant to air heat exchanger;

a second reversing element configured to reverse refrigerant flow through the refrigerant to source heat exchanger; and at least one blower coupled to the refrigerant to air heat exchanger to provide one of cool air from the refrigerant to air heat exchanger and hot air from the refrigerant to air heat exchanger to the structure.

13. The system of claim 12, further comprising a second reversing element configured to reverse the flow of the refrigerant through the refrigerant to source heat exchanger.

14. The system of claim 13, where the second reversing element is configured to produce counter-current flow of the refrigerant through the refrigerant to source heat exchanger.

15. The system of claim 12, where the refrigerant to source heat exchanger is one of a ground and air source heat exchanger.

16. A method of providing heated or cooled air and heated water, comprising:

compressing, by a compressor, a low-pressure vapor refrigerant to high-pressure vapor refrigerant;

condensing, by a refrigerant condensing heat exchanger, at least a portion of the high-pressure vapor refrigerant to transfer heat from the refrigerant to water for at least one of heating and domestic use and produce a high-pressure liquid phase refrigerant;

subcooling, via a refrigerant subcooling heat exchanger, the high-pressure liquid refrigerant;

expanding, via an expansion valve, the subcooled high-pressure liquid refrigerant to produce a low-pressure cooled liquid refrigerant;

evaporating, via a refrigerant evaporating heat exchanger, the low-pressure cooled liquid refrigerant to provide the low-pressure vapor refrigerant to the compressor; and circulating air, via at least one blower, to provide one of cool air from the evaporating heat exchanger and hot air from the cooling heat exchanger to an outlet for cooling and heating.

17. The method of claim 16, further comprising reversing, via a first reversing element, the refrigerant flow between a heating and cooling mode, where in the heating mode, the cooling heat exchanger is a refrigerant to air heat exchanger and the refrigerant evaporating heat exchanger is a refrigerant to source heat exchanger, and in the cooling mode, the cooling heat exchanger is the refrigerant to source heat exchanger and the refrigerant evaporating heat exchanger is the refrigerant-air heat exchanger.

18. The method of claim 17, further comprising reversing, via a second reversing element, the refrigerant flow to produce counter-current flow of the refrigerant through the refrigerant to source heat exchanger in both the heating and cooling modes.

* * * * *